US012305411B2

(12) United States Patent
Sollenberger et al.

(10) Patent No.: US 12,305,411 B2
(45) Date of Patent: May 20, 2025

(54) SYSTEM FOR ACCESSING AND/OR ALLOWING SAFE MOVEMENT ON A UNIT MOUNTED ON A STRUCTURAL SUPPORT

(71) Applicant: Hoffman & Hoffman, Inc., Greensboro, NC (US)

(72) Inventors: Nathan Brian Sollenberger, Charlotte, NC (US); Ryan Charles Kerfein, Huntersville, NC (US)

(73) Assignee: Hoffman & Hoffman, Inc., Greensboro, NC (US)

( * ) Notice: Subject to any disclaimer, the term of this patent is extended or adjusted under 35 U.S.C. 154(b) by 1038 days.

(21) Appl. No.: 17/286,299

(22) PCT Filed: Mar. 31, 2021

(86) PCT No.: PCT/US2021/025143

§ 371 (c)(1),
(2) Date: Apr. 16, 2021

(87) PCT Pub. No.: WO2021/202705

PCT Pub. Date: Oct. 7, 2021

(65) Prior Publication Data

US 2023/0151621 A1 May 18, 2023

Related U.S. Application Data

(60) Provisional application No. 63/002,800, filed on Mar. 31, 2020.

(51) Int. Cl.
*E04G 5/14* (2006.01)
*E04G 7/02* (2006.01)

(52) U.S. Cl.
CPC ..... *E04G 5/14* (2013.01); *E04G 7/02* (2013.01)

(58) Field of Classification Search
CPC ..... E06C 1/24; E06C 5/02; E06C 5/04; E06C 5/06; E06C 5/14; E06C 5/41; E06C 5/46;
(Continued)

(56) References Cited

U.S. PATENT DOCUMENTS 4,776,429 A * 10/1988 Osborn ..... B65G 69/22 182/147
4,856,616 A * 8/1989 Anderson ..... E04G 5/045 182/113

(Continued)

FOREIGN PATENT DOCUMENTS

WO 2009/129607 A1 10/2009

OTHER PUBLICATIONS

Jun. 23, 2021 International Search Report issued in International Patent Application No. PCT/US21/25143.

(Continued)

*Primary Examiner* — Colleen M Chavchavadze
(74) *Attorney, Agent, or Firm* — Williams Mullen; R. Brian Drozd

(57) ABSTRACT

Various embodiments and features of railing systems are provided. For example, the railing system may be disposed around industrial/commercial equipment (e.g., rooftop condensing unit) that includes a baserail near the bottom of the industrial/commercial equipment and may be disposed on a structural support. The railing system may include a plurality of vertical supports extending from the baserail or structural support to above a top portion of the industrial/commercial equipment; railing extending between the vertical supports; and an attachment system to attach the vertical supports to the baserail or structural support so that the vertical supports are configured to distribute any weight received directly to the baserail or structural support via the attachment system.

12 Claims, 22 Drawing Sheets

(58) Field of Classification Search
CPC . E06C 5/48; E06C 5/062; E06C 5/064; E06C 5/067; E06C 7/02; F24F 13/20
See application file for complete search history.

(56) References Cited

U.S. PATENT DOCUMENTS

| | | | | |
|---|---|---|---|---|
| 5,182,889 | A | 2/1993 | Johnson | |
| 5,232,636 | A | 8/1993 | Cates et al. | |
| 5,586,423 | A | 12/1996 | Mullen | |
| 5,678,375 | A * | 10/1997 | Juola | E04B 1/24 52/236.7 |
| 5,851,446 | A * | 12/1998 | Bardo | F28F 25/00 261/DIG. 11 |
| 6,270,057 | B1 | 8/2001 | Highley et al. | |
| 7,059,088 | B2 * | 6/2006 | Lattanzio | F24F 13/20 256/25 |
| 7,228,939 | B1 * | 6/2007 | Prater | B66F 7/04 182/141 |
| 8,448,923 | B1 * | 5/2013 | Schad | E04G 21/3219 256/65.03 |
| 8,607,515 | B2 * | 12/2013 | Jarvis | E04B 1/0038 403/258 |
| 9,187,904 | B2 * | 11/2015 | Stanton | E21B 41/0021 |
| 9,410,330 | B2 * | 8/2016 | Berry, Jr. | E04G 1/24 |
| 9,803,380 | B2 * | 10/2017 | Simmons | E04G 5/144 |
| 10,883,275 | B2 * | 1/2021 | O'Shea | E04F 11/18 |
| 11,149,450 | B2 * | 10/2021 | White | E04G 17/002 |
| 11,203,867 | B2 * | 12/2021 | Ferland | F24F 13/20 |
| 11,549,274 | B2 * | 1/2023 | Black | E04G 21/3204 |
| 2006/0180391 | A1 | 8/2006 | Thomas et al. | |
| 2009/0019789 | A1 * | 1/2009 | Gephart | F24F 13/20 256/25 |
| 2010/0281816 | A1 * | 11/2010 | Vigneault | E04G 5/046 52/701 |
| 2010/0294593 | A1 | 11/2010 | Gordon | |
| 2014/0262619 | A1 * | 9/2014 | Bains | E04G 7/34 248/351 |
| 2019/0257096 | A1 | 8/2019 | Caskey et al. | |

OTHER PUBLICATIONS

Jun. 23, 2021 Written Opinion issued in International Patent Application No. PCT/US21/25143.

Mar. 14, 2024 Extended European Search Report issued in European Patent Application No. 21779015.3.

Dfp: "HVAC Fall Protection Systems;" pp. 1-10; Sep. 30, 2016; Retrieved from the Internet: URL: https://www.fallprotect.com/blog/techtalk/hvac-system-fall-protection.

Dakota Safety, "KwikGuard Modular Handrail | Guardrail Fall Protection Chiller / HVAC", Microsoft Bing, https://www.bing.com/images/search?view=detailV2&ccid=s8VTYyU0&id=F290C7245900F2C6AB26F701564673E33988CAED&thid=OIP.s8VTYyU0MISieunwzUtUGwHaLl&me diaurl=https%3A%2F%2Fcdn.shopify.com%2Fs%2Ffiles%2F1%2F0067%2F8936%2F5 875%2Fproducts%2FColoplast_Chiller_Units66_800x.jpg%3Fv%3D1612564517&cdnurl =https%3A%2F%2Fth.bing.com%2Fth%2Fid%, (Mar. 12, 2019).

Dakota Safety, "Kwik Guard for Chiller / HVAC fall protection", YouTube, https://www.youtube.com/watch?v=PGFrBIQ3HEs, Jan. 23, 2014 (Jan. 23, 2014).

* cited by examiner

SYSTEM FOR ACCESSING AND/OR ALLOWING SAFE MOVEMENT ON A UNIT MOUNTED ON A STRUCTURAL SUPPORT

FIELD

Embodiments of the present application relate generally to systems and methods for accessing and/or allowing safe movement on a large structure that rests on a structural support (e.g., a curb, a baserail, etc.).

BACKGROUND

Currently, buildings have large industrial/commercial equipment, such as large rooftop unit ("RTU") systems and cooling towers, that are at least six feet tall. However, while such equipment requires servicing, repairs, etc., it may be difficult to access the top of these systems due to the large size and height.

There is currently no safe and secure system that allows one to service, repair or perform maintenance on the top of the equipment. There is no current system that allows for quick and easy installation of a structurally safe railing system for working on such equipment.

SUMMARY

Various embodiments of railing systems and features thereof are provided herein. For example, railing systems are disclosed that provide railings above the top surface of the equipment but distribute any weight applied to the railing system, via vertical supports, to only a support structure (e.g. the curb the RTU rests on, the baserail of the RTU, etc.). This attachment method allows for a structurally sound and safe railing system but also a quick and easy install process for the railing system that can be applied to any industrial/commercial equipment.

The railing systems disclosed herein also could have anchorage points (also referred to "tie off" points) at the top of the vertical supports and/or floating floor systems on top of the industrial/commercial equipment.

Generally herein, the railing system may be disposed around industrial/commercial equipment (e.g., rooftop condensing unit) that includes a baserail near the bottom of the industrial/commercial equipment and may be disposed on a structural support (e.g. a curb). The railing system may include a plurality of vertical supports extending from the baserail or structural support to above a top portion of the industrial/commercial equipment; railing extending between the vertical supports; and an attachment system to attach the vertical supports to the baserail or structural support so that the vertical supports are configured to distribute any weight received directly to the baserail or structural support via the attachment system.

In one specific embodiment, a railing system to be disposed around industrial/commercial equipment. The industrial/commercial equipment comprises a baserail near the bottom of the industrial/commercial equipment. The railing system may include a plurality of vertical supports extending from the baserail to above a top portion of the industrial/commercial equipment; railing extending between the vertical supports; and at least one attachment clip corresponding to a first vertical support of the plurality of vertical supports and being configured to be attached to the baserail so that the first vertical support is configured to distribute any weight received directly to the baserail or curbs via the at least one attachment clip.

In one embodiment, a railing system is disposed around industrial/commercial equipment. The industrial/commercial equipment is installed on a curb, where the curb includes a first opening on a first side. The railing system may include a plurality of vertical supports extending from the curb to above a top portion of the industrial/commercial equipment; railing extending between the vertical supports; and at least one tube insert comprising: a first tube insert comprising: (1) an insert portion sized to fit within the first opening; and (2) a base configured to attach to a corresponding vertical support. The at least one tube insert allows the corresponding vertical support to distribute any weight received only to the curb via the at least one insert.

BRIEF DESCRIPTION OF THE DRAWINGS

Aspects of the present invention is further described in the detailed description which follows in reference to the noted plurality of drawings by way of non-limiting examples of embodiments of the present invention in which like reference numerals represent similar parts throughout the several views of the drawings and wherein.

DETAILED DESCRIPTION

Figure 1:
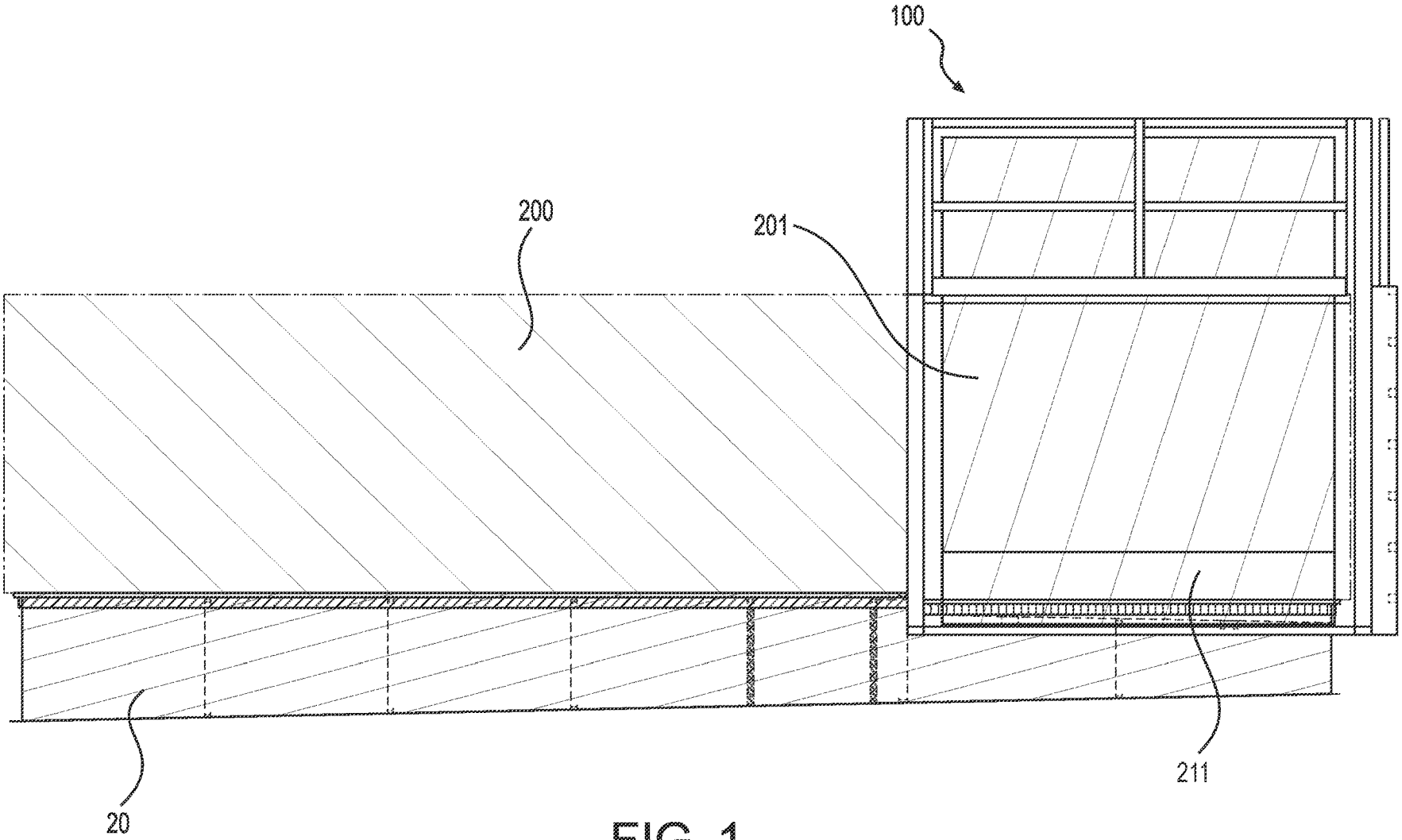
FIG. 1 illustrates a side view of a condenser railing system implemented on an RTU system, according to one embodiment.

Some embodiments of the present application will now be described below.

Below is a discussion of: Railing System With Extended Curb Clip, Railing System With Short Curb Clip, Railing System With Curb Insert, Tie Off Points, and Floating Floor System. These embodiments are discussed below with corresponding Headers.

I. Railing Systems

Generally speaking, large industrial/commercial equipment require someone to access the top of the unit for maintenance, repairs, installation, and other purposes for accessing the top of such equipment. The equipment is at least six feet tall and thus, it is dangerous for someone to be that high up and also there may be areas on top of the equipment which the user may fall through.

The equipment may be any condenser unit, an air cooled water chiller, a remote condensing unit, a fuel tank, a cooling tower, any rooftop unit, and/or other industrial/commercial equipment requiring elevated servicing. The equipment typically has a baserail and/or is installed on a structural support (e.g., a curb). The baserail is a portion of the equipment which is used to lift the equipment using a crane or other lifting system. The baserail is made from a structurally strong material and typically does not have wires, tubes, etc. like other parts of the equipment. In one embodiment, the baserail of the equipment is located at the bottom 1-2 feet of the equipment and may have pre-drilled holes to allow bolts or other fasteners to be attached thereto. The baserail is a load bearing frame of the industrial/commercial equipment.

It should be understood that various embodiments of the present application below are described herein relative to a rooftop unit ("RTU") (e.g., an HVAC unit) on the roof of a building. However, the present invention should not be limited to being implemented onto an RTU unit and is meant to be implemented on any other industrial/commercial equipment system in which is elevated (e.g., at least 3 feet tall, at least 4 feet tall, at least 5 feet tall, etc.) relative to the surface that supports such device or system.

These devices or systems need not be on the roof of a building (or be a rooftop unit) but could be located at any other place where a structural support (e.g., a curb) supports a large industrial device or system (e.g., any device which may require someone to go to a higher or top portion of the system and such system should have a railing or support system so such person does not fall off such unit or within an edge or hole in the unit (e.g., a hole providing airflow for a fan). Such devices or systems may be supported using what is referred to herein as a "structural support", which could be a curb (e.g., a base plus a vibration isolation rail) that supports the weight of the industrial/commercial equipment and such structural support may be a device that is separate from the building or structure (or ground) that the structural support is placed upon.

Generally speaking, embodiments of railing systems may have at least one of two main purposes:

1—to provide a secure elevating means (e.g., a ladder) that allows a person to elevate or climb to access a top portion (or high portion) of the industrial/commercial equipment, whereby the railing system may not secured directly to the industrial/commercial equipment but instead directly only to the structural support or to only the industrial/commercial equipment; and 2—to provide a railing system that helps to protect a user or help prevent a fall from the top of the industrial/commercial equipment (or a fall into the industrial/commercial equipment), whereby the railing system is either (A) not secured directly to the industrial/commercial equipment (in one embodiment) but instead directly only to the structural support or (B) whereby the railing system is secured directly to a only a bottom portion (e.g., baserail) of the industrial/commercial equipment (in another embodiment)).

Referring to FIGS. 1-19, railing systems now be described according to various embodiments. As mentioned above, railing system can be applied to any industrial/commercial equipment, but is explained with regard to FIGS. 1-19 using an RTU for ease of explanation but should not be limited to this application.

Generally, the railing systems discussed herein may include the following features: a ladder 3 (or other "elevating means" that is configured to allow a user to move to the top of the industrial/commercial equipment), vertical tubes 10, and horizontal tubes 14 (also referred to herein a "railing") which are connected between the vertical tubes 10 at or near the top of the industrial/commercial equipment. Also, in addition to these features, the railing systems may further include railing 14 that is connected to the vertical tubes 10 so that the railing 14 extends above the top of the industrial/commercial equipment and is vertically supported only by the vertical tubes 10.

In one embodiment, the railing systems described herein may have diagonal support 107 from one vertical support 10 to an adjacent vertical support 10 since the vertical supports 10 extend a long length to provide structural support. This provides extensive support in the case of a heavy load, wind forces, or any other forces applied to the railing system.

More details of the various embodiments are disclosed below with different headings.

Railing System with Extended Attachment Clip

Referring first to FIGS. 1-7, a railing system 100 with an extended attachment clip will now be described according to various embodiments.

As mentioned above, railing system can be applied to any industrial/commercial equipment, but is explained with regard to FIGS. 1-7 with regard to an RTU for ease of explanation but should not be limited to this application.

Figure 2:
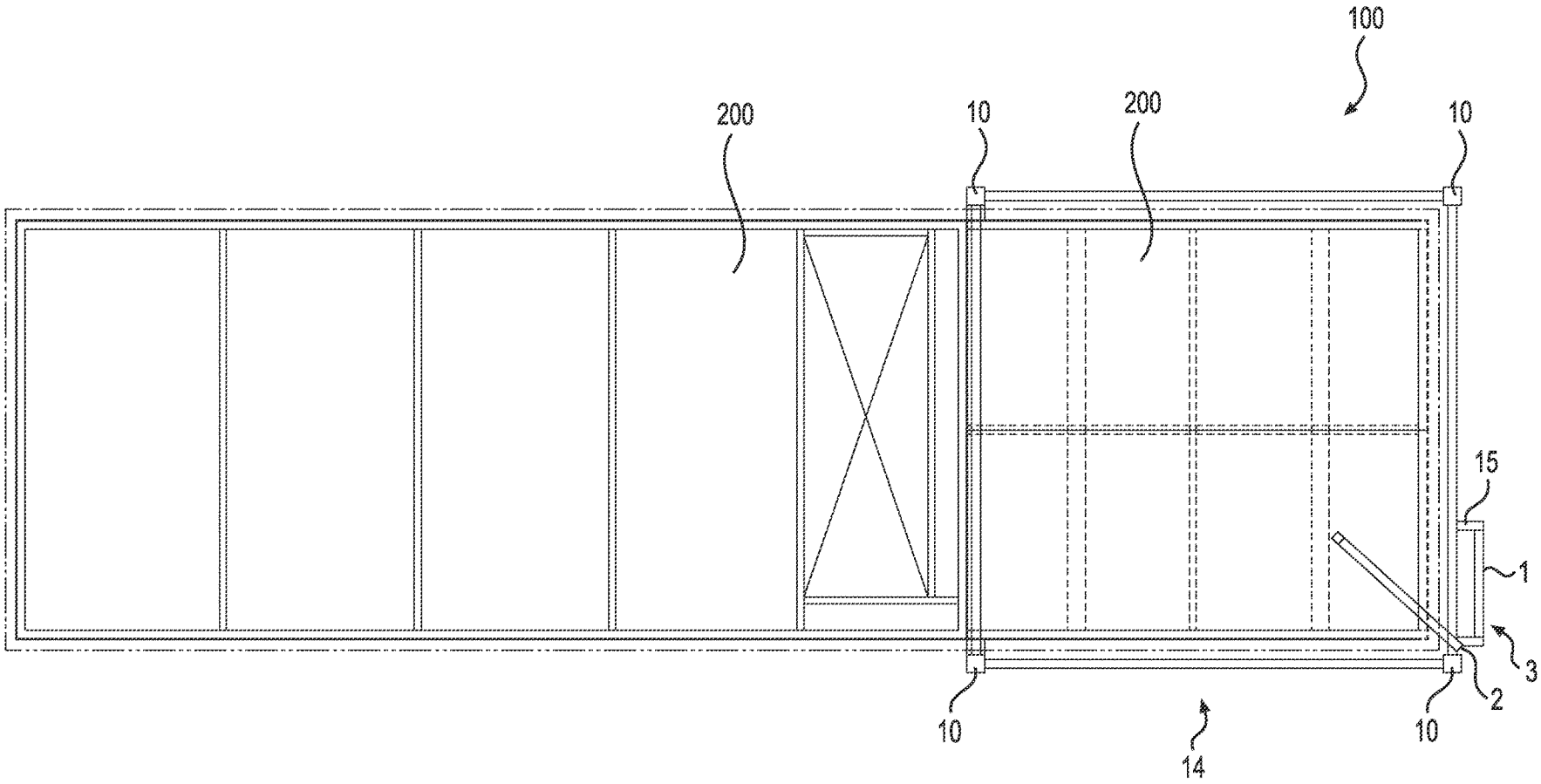
FIG. 2 illustrates a top view of the condenser railing system of FIG. 1.
Figure 3:
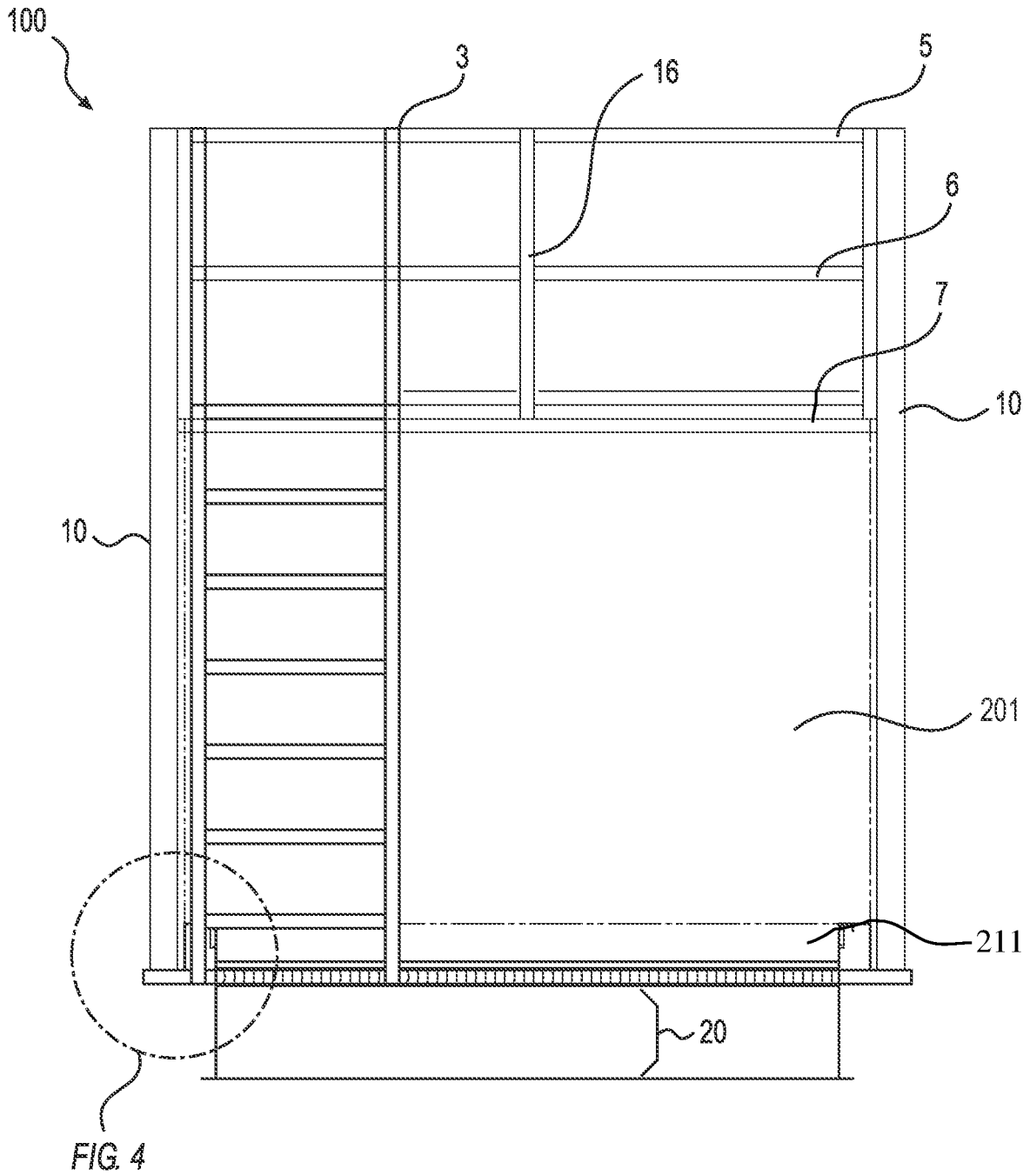
FIG. 3 illustrates a front view of the condenser railing system of FIG. 1.
Figure 4:
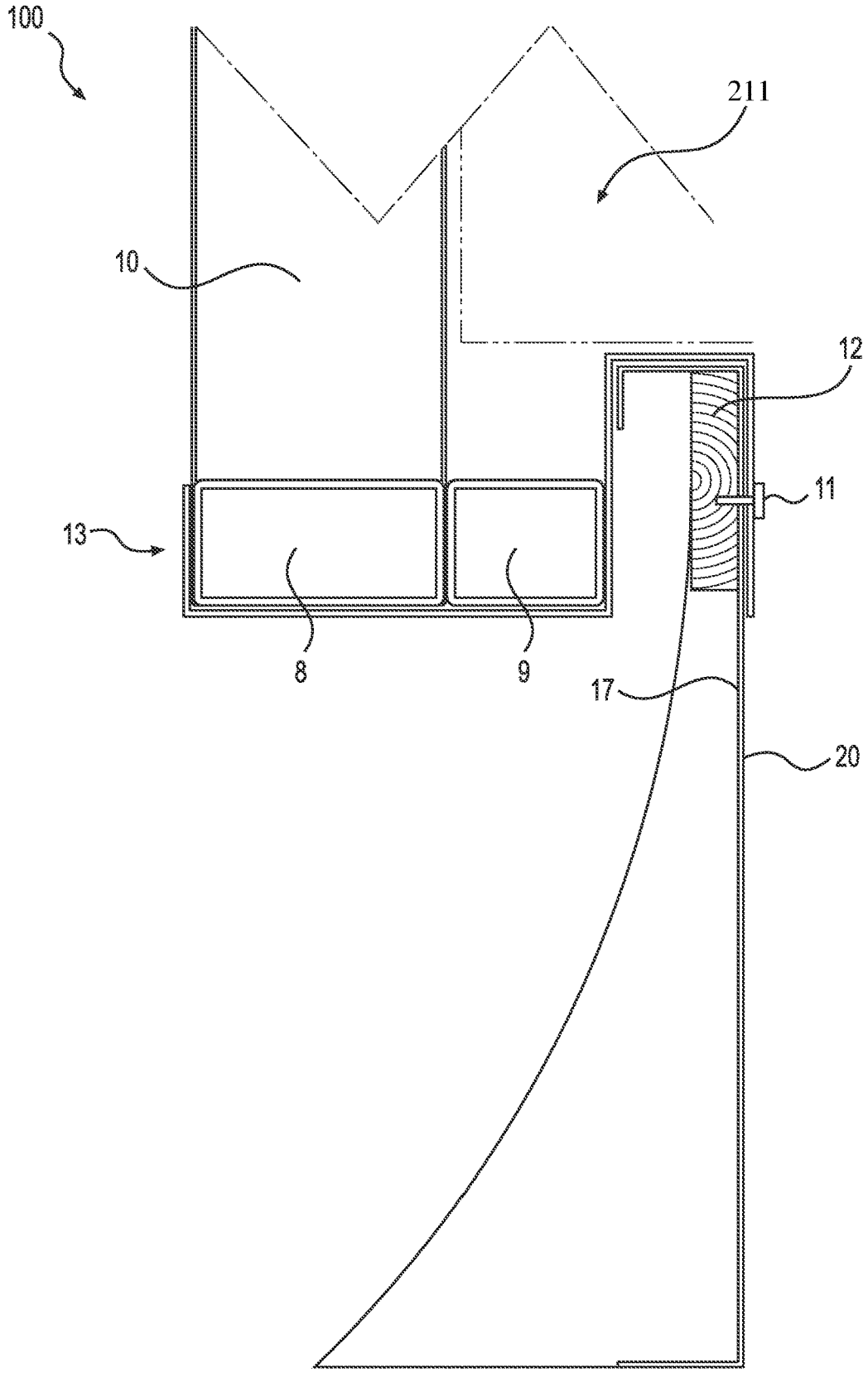
FIG. 4 illustrates a cross-sectional view at one point where the condenser railing system connects to the RTU system using a clip where the clip is connected to the RTU system before the RTU system is attached to the curb, according to the embodiment of FIG. 1.

Referring to FIGS. 1-4, FIG. 1 illustrates a side view of a condenser railing system 100 implemented on an RTU system 201, according to one embodiment, FIGS. 2 and 3 illustrate top and front views, respectively, of the condenser railing system of FIG. 1, and FIG. 4 illustrates a cross-sectional view at one point where the condenser railing system connects to the RTU system using a attachment clip 13, where the attachment clip 13 is connected to the RTU system 100 before the RTU system 100 is attached to the curb 20, according to the embodiment of FIG. 1.

The attachment clip 13 may be installed and welded (or bolted using a bolt 11) to the internal face 17 of the curb wall along both long sides of the condenser section.

As shown in FIG. 4, a 4×2 tube 8 and a 2×2 tube 9 section is placed in both clip channels and welded (or bolted) in place. The clip channels may extend completely along the side of the RTU system 201 (or curb 20 in another embodiment). An additional tube 9 may connect the tubes 8 (located in the clips channels) to form a "U" structure around the back of the unit. The "U" connection provides structural support for the ladder, upper structure and railing.

In some embodiments, vertical supports 10 may be connected to the tubes 8 in a vertical alignment along both sides of the RTU 201. The vertical supports 10 may extend from the attachment clip 13 to at least 42" above the top of the RTU 201.

A square top structure 14 may include railings 14 connected in a square or rectangular pattern at the top of the RTU 201 to form the upper railing structure, including toeboard 7, midrail 6, handrail 5, and horizontal top rails 108. The railing 14 may not be connected directly to the RTU 201 so that the RTU 201 does not support the weight of (or weight on) the square top structure 14 according to this embodiment. In one embodiment, the railing is only attached to the vertical supports and the vertical supports are only connected to the baserail 211.

A ladder 3 is constructed from tube rungs 1 and tube section 15. The vertical supports for the ladder 3 are connected to the upper and lower structure at the back of the RTU 201.

A self-closing hinge 2 may be provided at the top of the ladder 3 as a safety precaution and also for OSHA compliance. The mid-rail 6 and hand rail 5 are connected between the vertical supports 10. As required by OSHA standards, support posts 16 may be used periodically between the vertical supports 10. A 4 in toeboard 7 may be installed at the base of the railing system that provides a barrier from the RTU to the railing so that a clearance or opening does not exist above the walking-working surface of the RTU and the railing for safety purposes.

As shown FIGS. 2-4, vertical posts 10 are connected to the curb 20. In one embodiment, the vertical posts 10 are only connected to the curb 20 and not to the RTU system 200. The vertical supports support all of the weight of the railings 14 and distribute the weight thereof directly to the curb 20 via a clip 13 in this embodiment. The clip 13 provides support for the vertical supports 10 and the clip 13 is shown in FIG. 4 as being bolted to the curb 20 from an inside surface 17 of the curb. The clip 13 then supports the vertical posts 10 and distributes the weight therefrom to the curb 20.

Figure 5C:
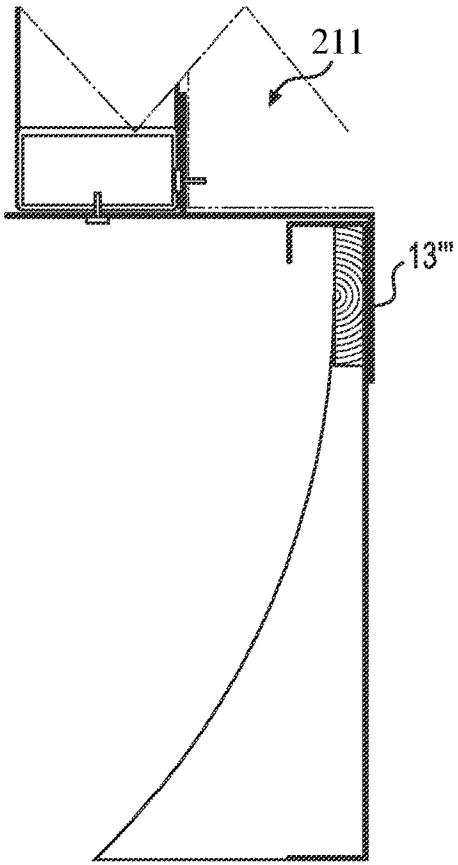
FIG. 5C illustrates a cross-sectional view at one point where the condenser railing system connects to the RTU system using a clip where the clip is connected to the RTU system before the RTU system is attached to the curb, according to another embodiment.
Figure 5B:
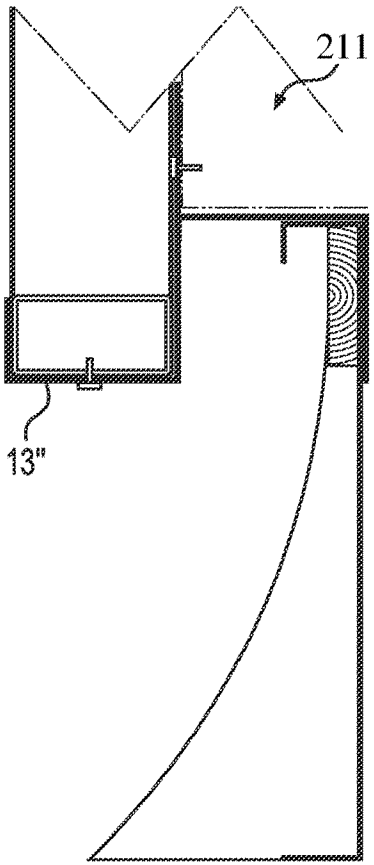
FIG. 5B illustrates a cross-sectional view at one point where the condenser railing system connects to the RTU system using a clip where the clip is connected to the RTU system before the RTU system is attached to the curb, according to one embodiment.
Figure 5A:
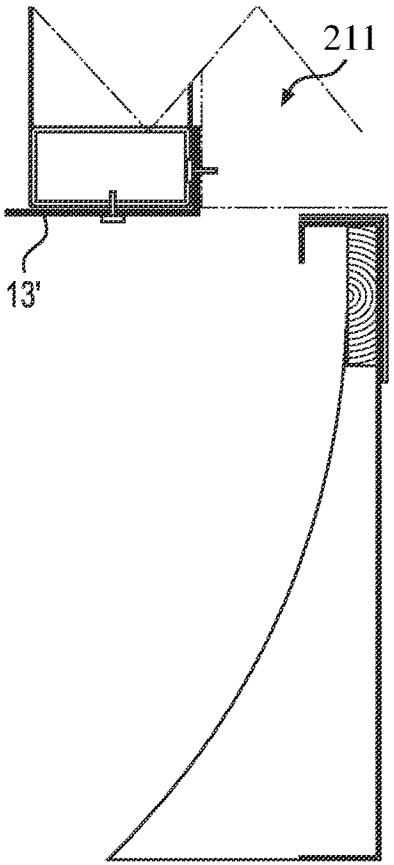
FIG. 5A illustrates a cross-sectional view at one point where the condenser railing system connects to the RTU system and this connection occurs after the RTU system has been attached to the curb, according to one embodiment.

FIG. 5A illustrates a cross-sectional view at one point where the condenser railing system 100 connects, using a clip 13', to the RTU system 201 and this connection occurs after the RTU system 100 has been attached to the curb 20, according to one embodiment; FIG. 5B illustrates a cross-sectional view at one point where the condenser railing system connects to the RTU system 100 using a clip 13" where the clip is connected to the RTU system before the RTU system 201 is attached to the curb 20, according to one embodiment; and FIG. 5C illustrates a cross-sectional view at one point where the condenser railing system connects to the RTU system using a clip 13''' where the clip 13''' is connected to the RTU system 100 before the RTU system is attached to the curb 20, according to another embodiment.

Each of FIGS. 5A-5C shows different clips 13', 13", and 13''' that may be used to support the vertical posts 10 of the system 100. In each instance, the clip 13, 13', 13", and 13''' attaches to the vertical posts 10 and the curb 20. For FIG. 5A, the RTU system is already connected to the curb 20 and the clip 13' attaches directly to the bottom of the RTU system 200 at a mounting area 60.

Figure 6:
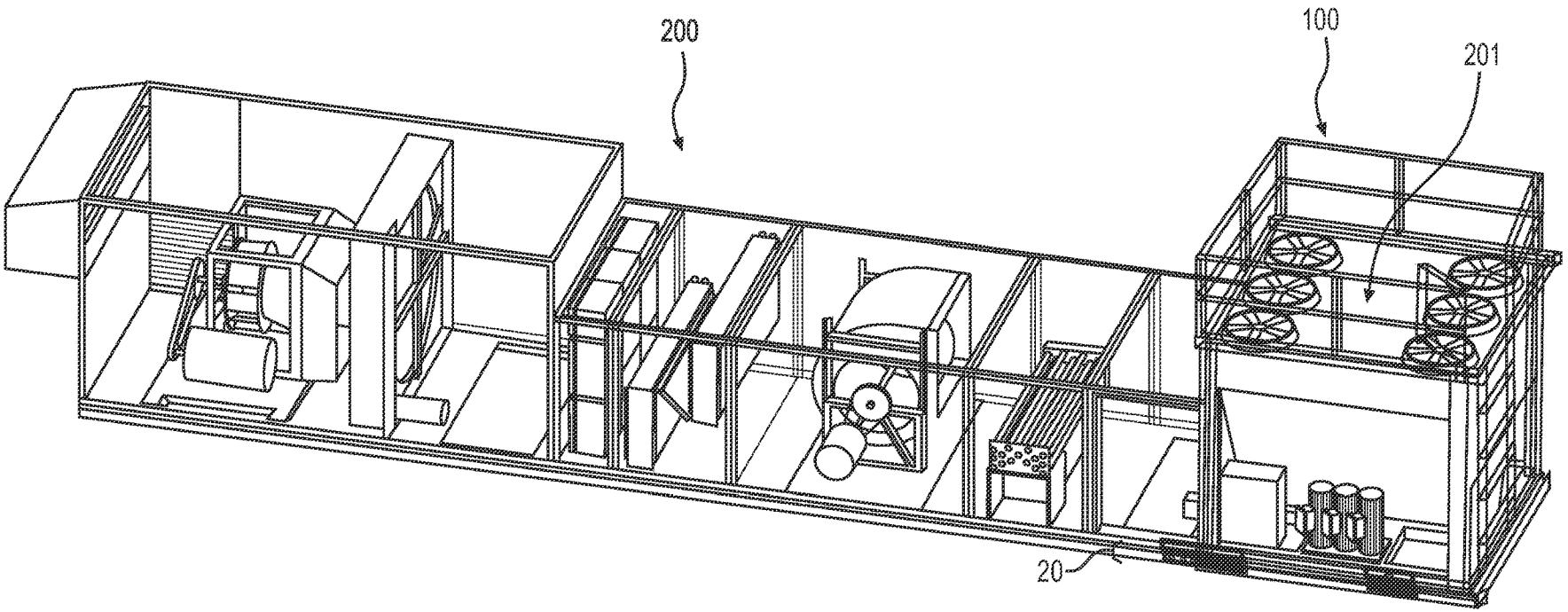
FIG. 6 illustrates a perspective view of a condenser railing system implemented on an RTU system that is already installed on a curb, according to one embodiment.
Figure 7:
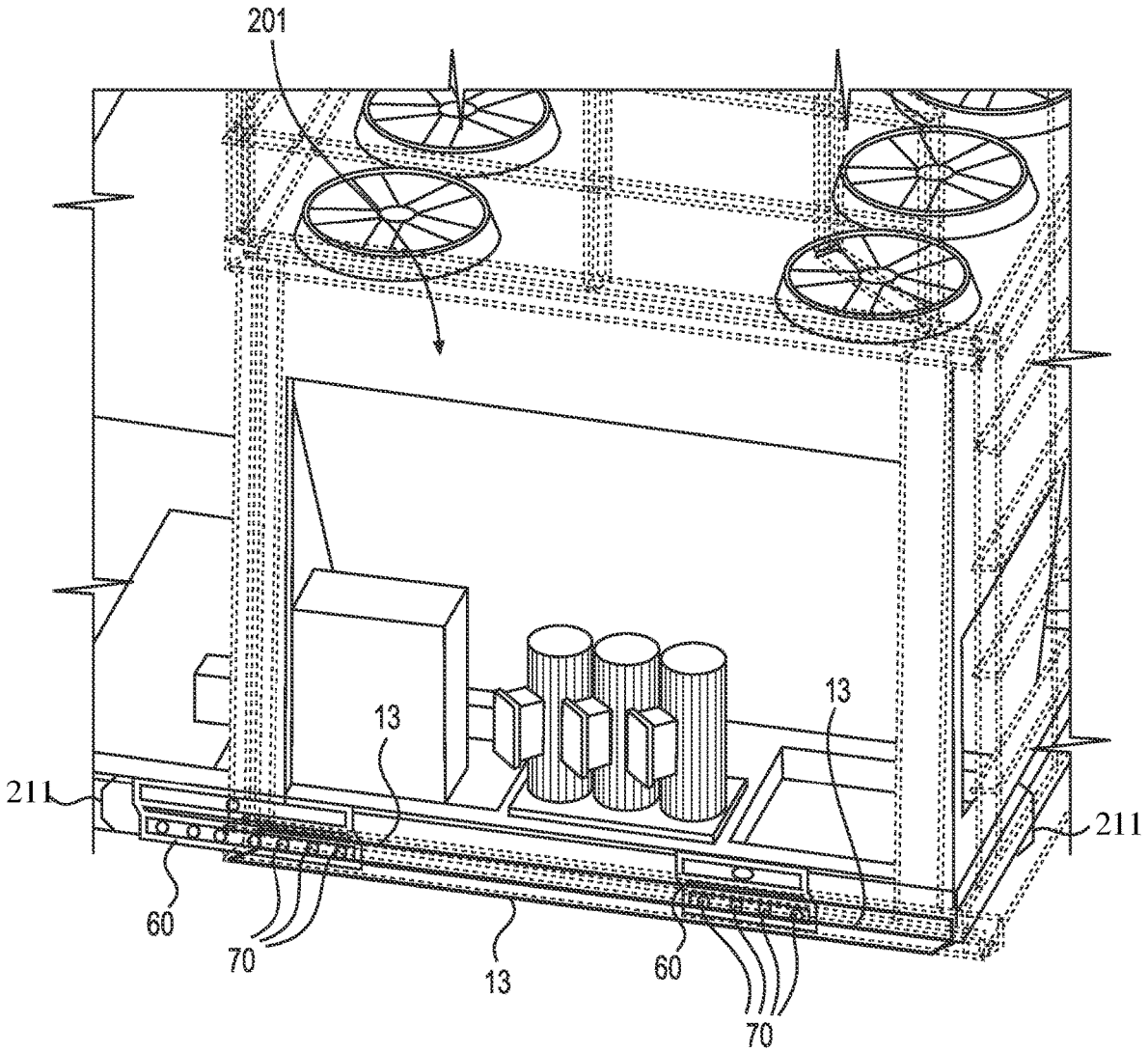
FIG. 7 illustrates a perspective view of a condenser railing system implemented on an RTU system that is already installed on a curb, according to one embodiment.

The mounting area 60 shows the RTU unit lifting lugs and splice plate. These items are used for rigging and lifting purposes and are integral to the RTU unit itself. In other words, the predrilled lifting lug/splice plate holes 70 are used to fasten the lifting lugs to the baserail of the RTU system 200 (as shown in FIGS. 6 and 7 which illustrate a perspective view of a condenser railing system implemented on an RTU system that is already installed on a curb, according to one embodiment).

The clips 13, 13', 13", and 13''' in this embodiment, extend between two vertical posts 10 and there are two clips for the system 100—one clip 13, 13', 13", and 13''' on one side of the RTU 201 and another clip 13, 13', 13", and 13''' on an opposite side thereof.

The vertical supports 10 connect to a respective clip via bolts (for example). Each clip 13, 13', 13", and 13''' may include adjustable slots so that the bolts of the vertical supports 10 can slide the vertical supports 10 horizontally allowing for adjustments in a direction perpendicular to the longitudinal length of the vertical supports 10.

In another embodiment, the vertical supports 10 could be unitary with the clips (e.g., welded, formed from a single piece of material, etc.)

It is noted that the railing system 100 is only attached to the RTU directly to the baserail such that it is not directly attached at any other location on the RTU and is not directly attached to any other component, such as the curb or the roof of the building.

The extended curb clip distributes the weight received from the vertical supports 10 along the length of the clip.

Railing System with Short Attachment Clip

FIGS. 8-14 illustrate a railing system 250 similar to the railing system 100 described above. While system 250 is explained with regard to an RTU, it should not be so limited and instead can be used for any industrial/commercial equipment similar to system 100 described above. However, one difference between railing system 250 and railing system 100 is the way the vertical posts 10 are supported as is explained below.

As mentioned above, the railing system 250 is similar to the railing system 100. For example, the railing system 250 includes vertical posts 10, railings 14, and the ladder 3 (among other features). However, the railing system 250 connects to the RTU baserail 211 at the mounting area 60 using different a clip system 150, which is described below.

The clip system 150 includes clips 80 and 82 (FIGS. 9A-B), brackets 15 (which connects to the clips 80 and 82), and a connector system 85, 86, 93, 96, 97, 98, 99 (including fasteners, washers, spacer plates, lifting lugs, and nuts).

Figure 8:
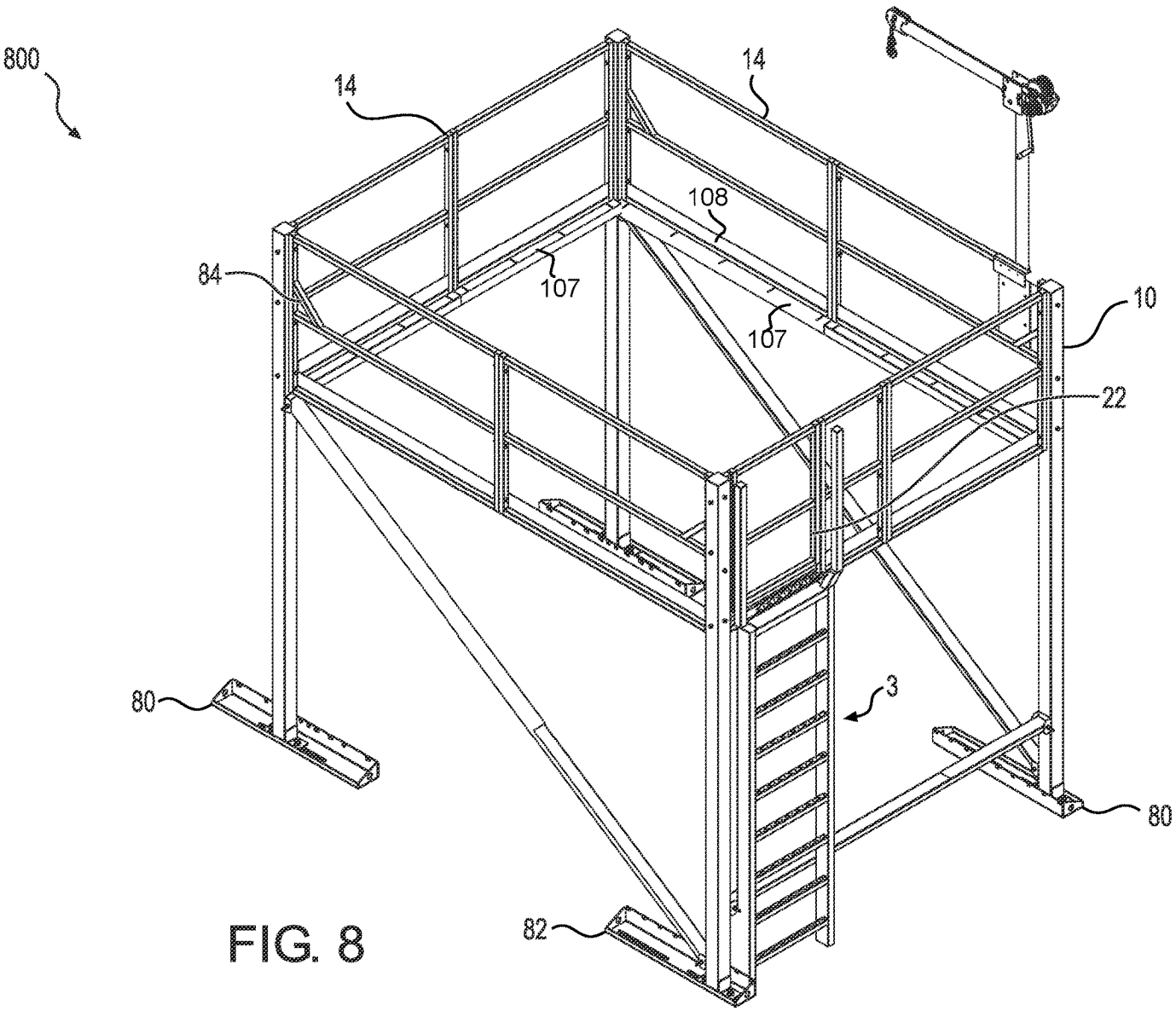
FIG. 8 illustrates a perspective view of a condenser railing system implemented on an RTU system that is already installed on a curb, according to another embodiment.
Figure 9A:
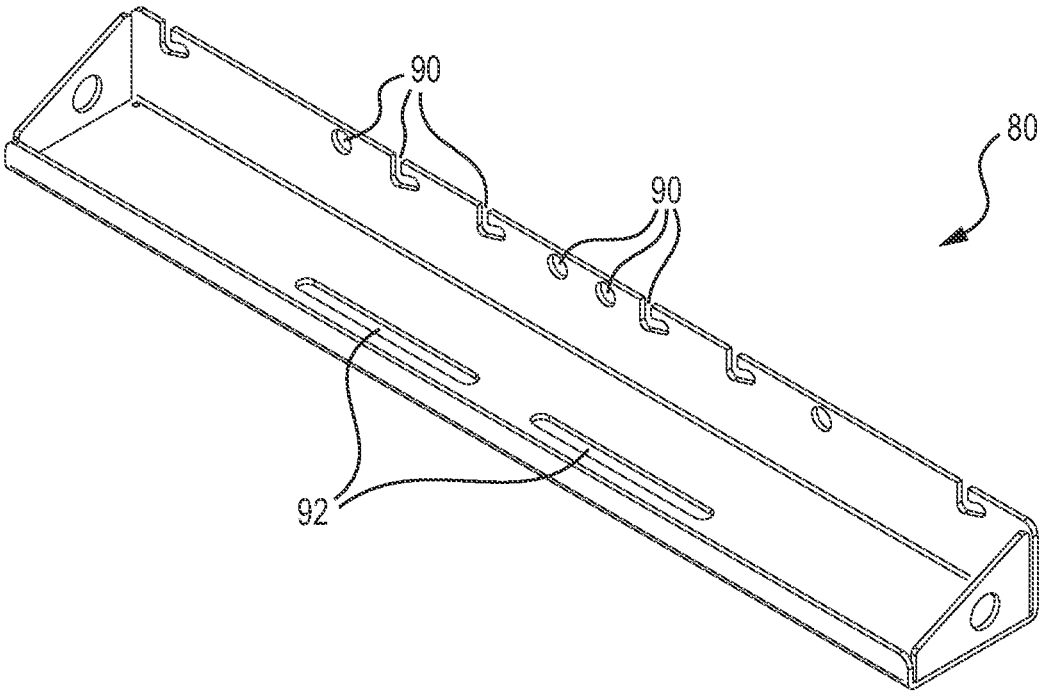
FIGS. 9A, 9B, 9C and 9D illustrate perspective views a clip of the condenser railing system of FIG. 8.
Figure 9B:
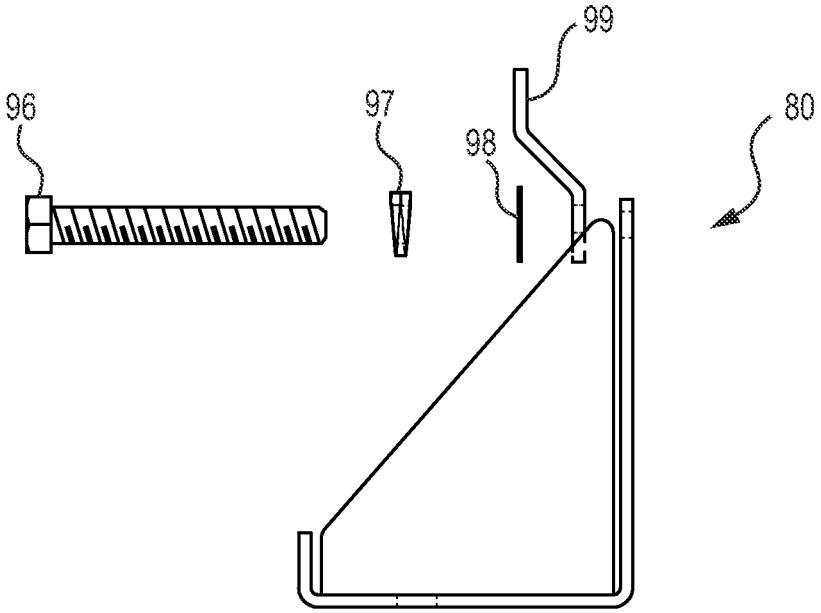
Figure 9C:
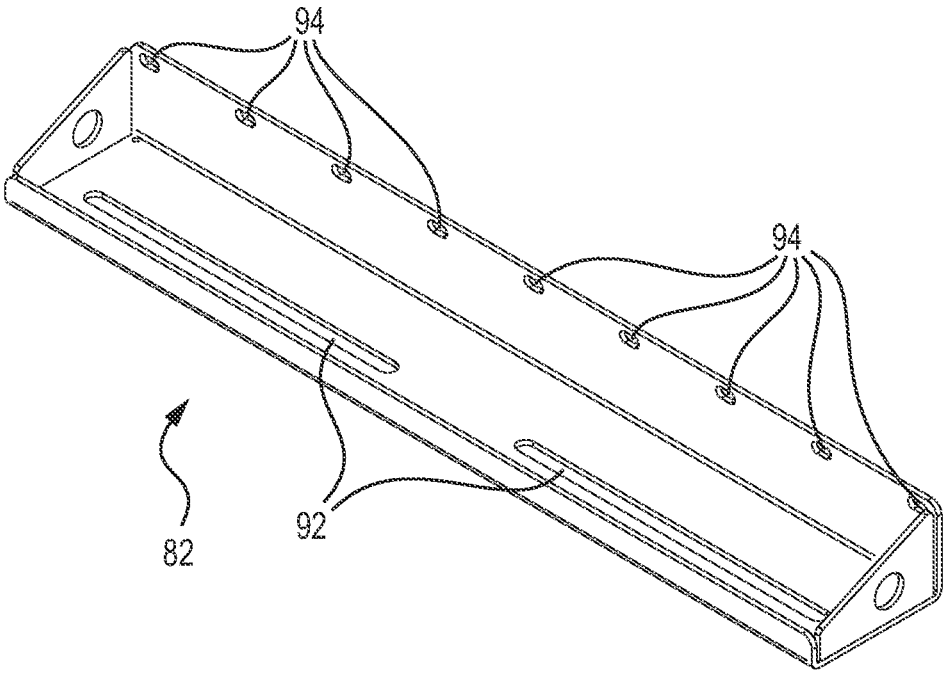
Figure 9D:
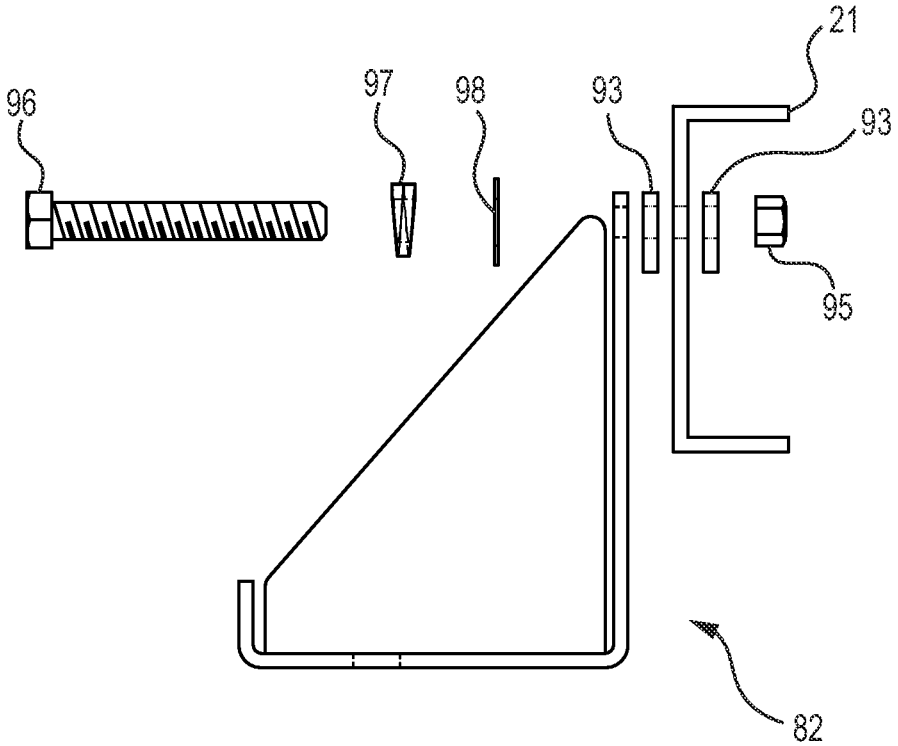
Figure 10A:
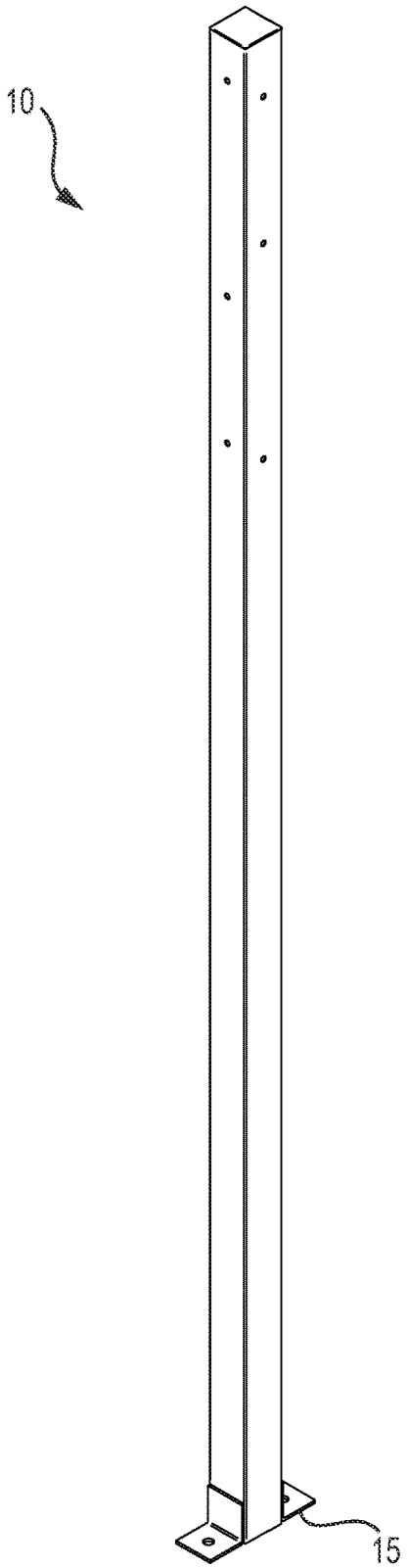
FIGS. 10A and 10B illustrate vertical supports of the condenser railing system according to an embodiment.
Figure 10B:
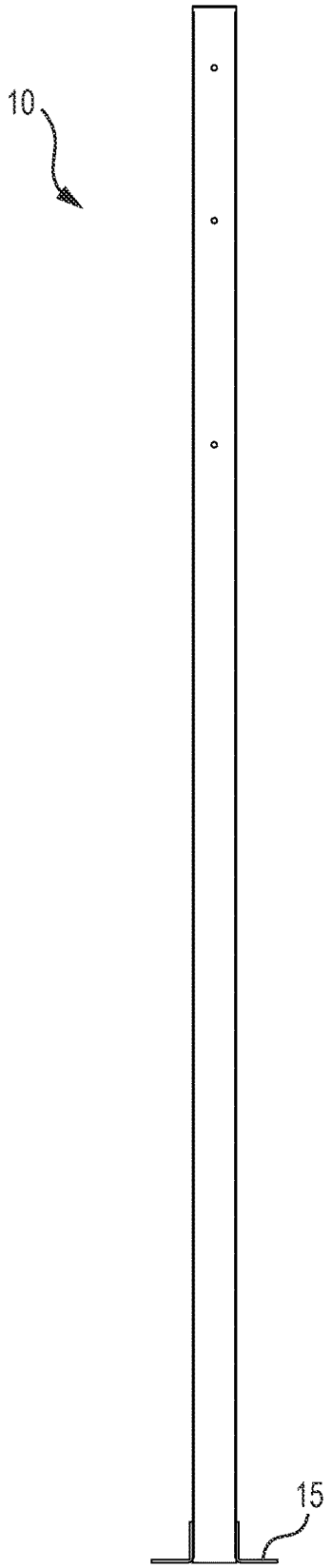
Figure 11B:
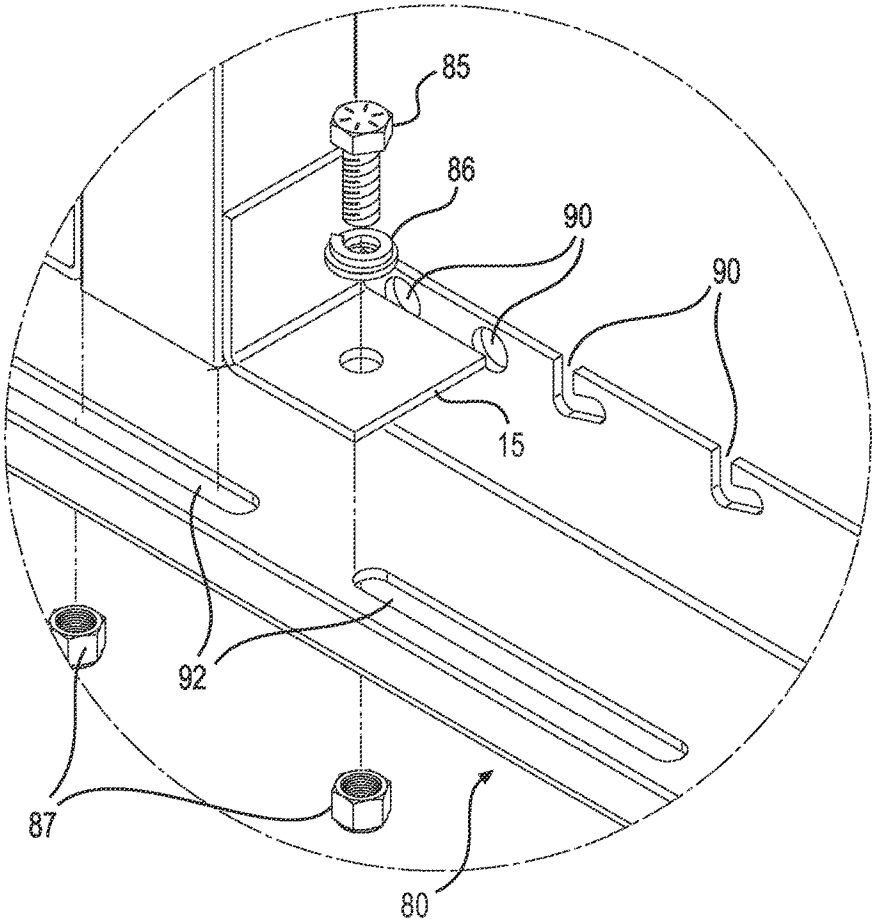
FIGS. 11A and 11B illustrate perspective views a clip of the condenser railing system of FIG. 8 and connecting the vertical supports thereto, according to embodiments.
Figure 11A:
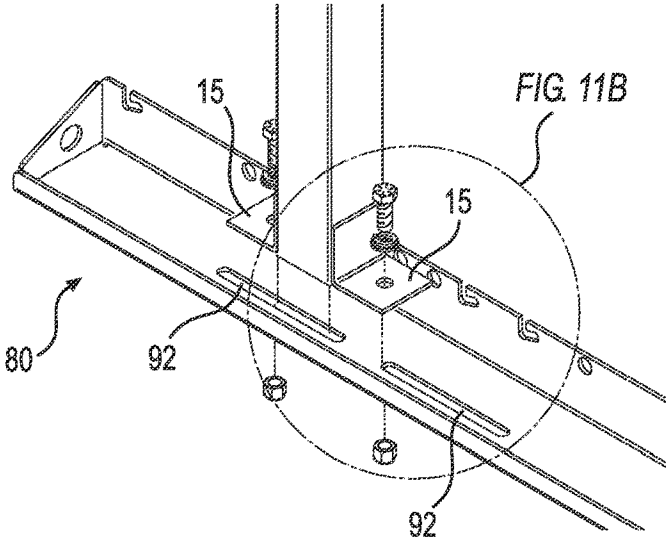
Figure 13:
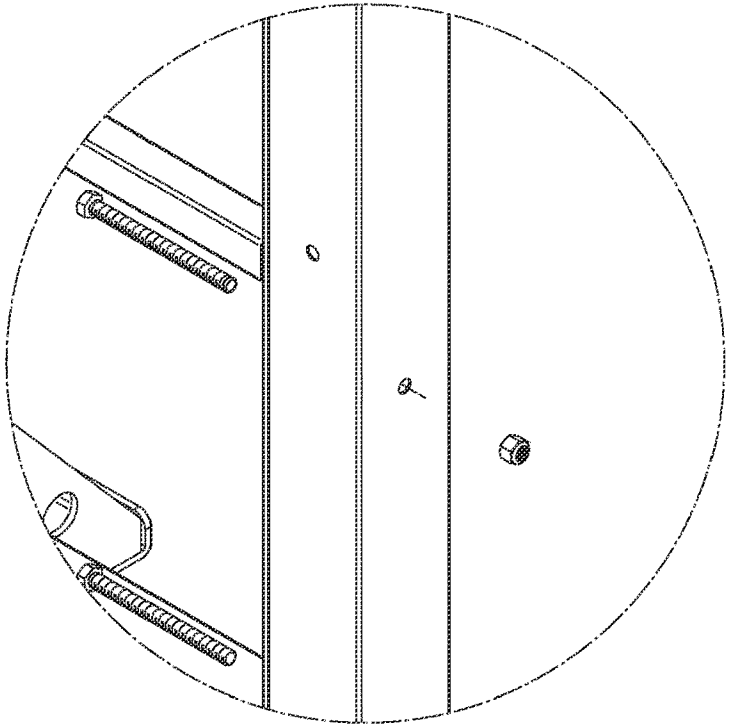
FIGS. 12 and 13 illustrate perspective views a portion of the condenser railing system of FIG. 8 and connecting the railing to the vertical supports thereto, according to embodiments.
Figure 12:
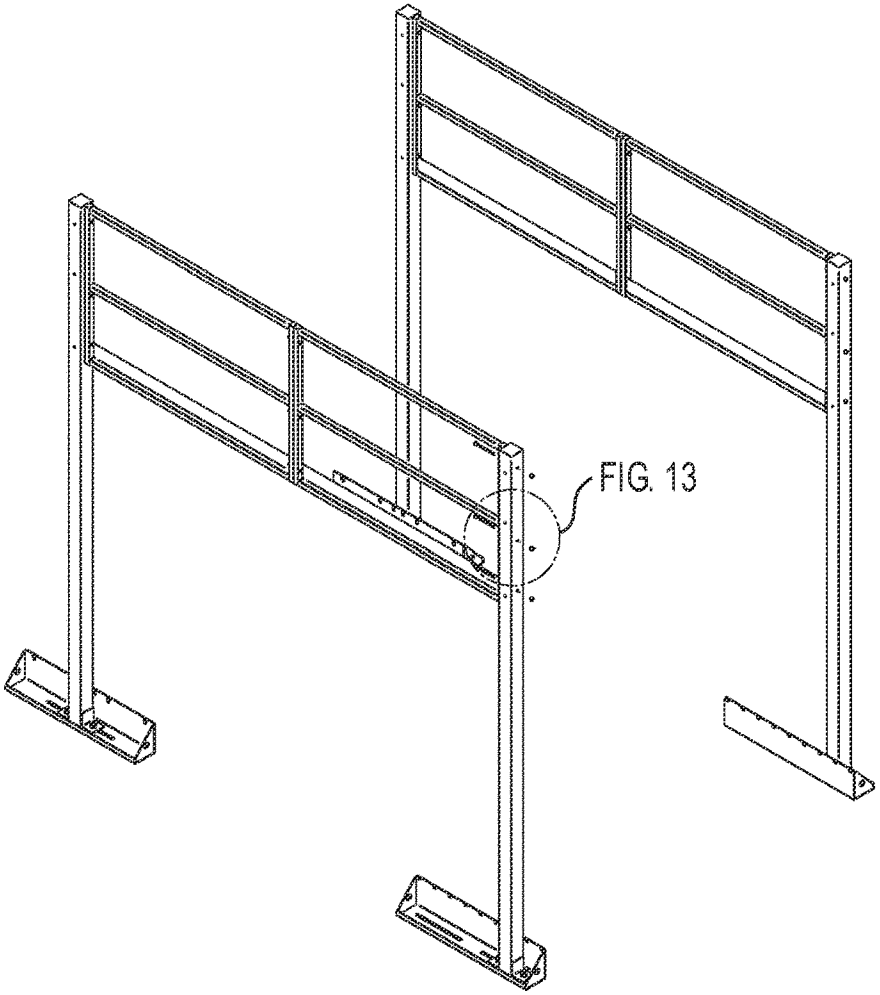
Figure 14B:
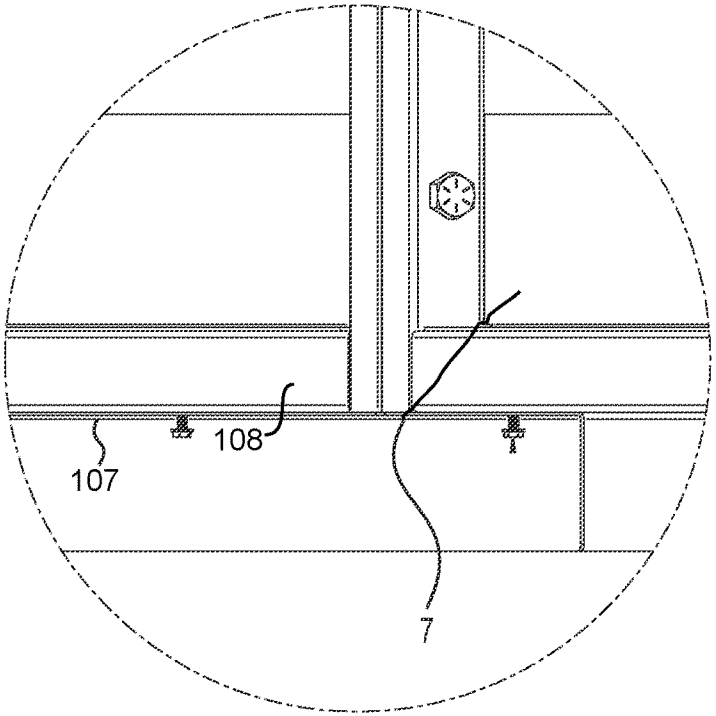
FIGS. 14A, 14B and 14C illustrate the condenser railing system of FIG. 8 and the toeboard thereof, according to embodiments.
Figure 14C:
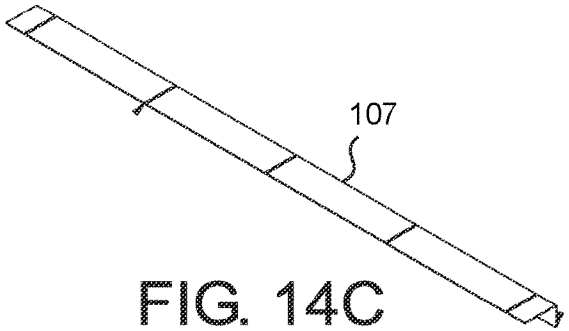
Figure 14A:
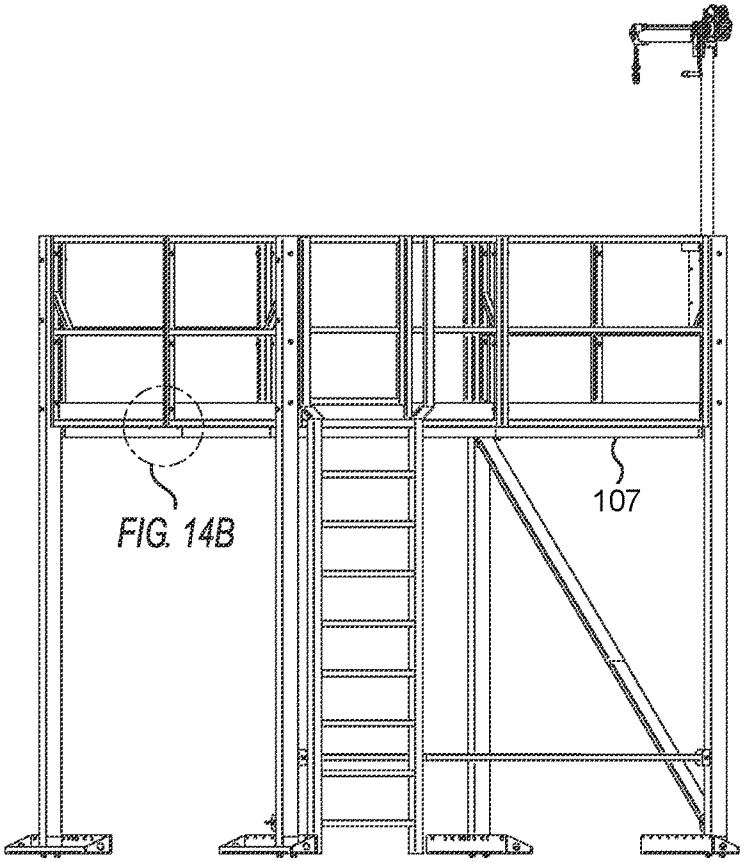

A first clip 80 may be a unit to condenser clip assembly which connects proximate to a middle of the RTU, and a second clip 82 may be a condenser end clip assembly that connects at an end of the RTU, as shown in FIG. 8.

As shown in FIG. 9, each of the clips 80 and 82 include adjustable slots 92 so that the bolts 85 that connect the vertical supports 10 to the clips 80, 82 allow the vertical supports 10 to slide horizontally along the slots allowing for adjustments in a direction perpendicular to the longitudinal length of the vertical supports 10. Once the vertical supports 10 are adjusted to the right position (e.g., the vertical supports are all exactly vertical (e.g., perpendicular to the slots), then the bolts 85 connect the tabs 15 of the vertical supports 10 to the clips 80, 82, respectively.

The clips 80, 82 may include holes so that a connection system may connect thereto. The connection system for clip 82 may include bolts 96, nuts 95, washers 97, 98, spacers 93, spacer plates 93 and for clip 80, the connection system may include bolts 96, washers 97, 98, and lifting lug 99.

In this system, the clip 80, 82 is attached to the base rail of the RTU. As such the RTU is fully supporting all of the weight and forces from the railing system 250.

It is noted that the railing system 250 is not secured to the top of the RTU and is only attached directly to the baserail.

The curb clip 80, 82 distributes the weight received from the vertical supports 10 along the length of the clip 80, 82. However, clip 80, 82 differs from clips 13, 13', 13", 13''' because 80, 82 does not completely extend horizontally between two vertical supports 10 (which is what clips 13, 13', 13", 13''' do). Indeed, clip 80, 82 extends a certain distance on each side of the vertical posts. Clip 80, 82 therefore distributes weight along the length of the clip 80, 82. The advantage of using clip 80, 82 over clips 13, 13', 13", 13''' is that clip 80, 82 is lighter in weight than clips 13, 13', 13", 13''' (because it does not use as much material) and thus, allows for a railing system with clip 80, 82 to be lighter than the railing system with clips 13, 13', 13", 13'''. This can be advantageous in install and also in the amount of forces applied to the curb.

Attachment clip 82 is configured so that the post can connect to the clip but also extend at least 8 inches off of the RTU, which will allow the ladder 3 to be spaced from the RTU at least 8 inches to comply with OSHA. Indeed, the railing systems herein are each OSHA compliant with regard to: 1926 Subpart M—Fall Protection and 1926 Subpart X—Stairways and Ladders.

In one embodiment, the attachment clip can be attached to the vertical post (via welding, bolts, etc.) prior to installation and the clip can have holes that are extended and such attachment clip can be attached to the RTU via these holes. In this regard, the vertical supports 10 do not need to be attached to a separate attachment clip at the time of installation but instead can be a portion of the vertical support that simply get attached directly to the baserail 211.

Railing System with Curb Insert

FIGS. 15-17 illustrate a railing system 300 similar to the railing system 100 described above. However, railing system 300 and railing system 100 also supports the vertical posts 10 in different manners as is explained below. Indeed, in railing system 300, the supports 10 are supported directly by the curb 20 and railing systems 100 and 250 are supported directly by a baserail of the RTU 201.

Like railing systems 250 and 100, railing system 300 may include vertical posts 10, railings 14, and the ladder 3 (among other features). However, the railing system 300 connects to a tube that is within the curb 20 (or a receiving portion of the curb), which is described below. In this regard, the curb 20 and supporting tube 202 support all of the forces of and applied to the railing system 300.

Figure 15A:
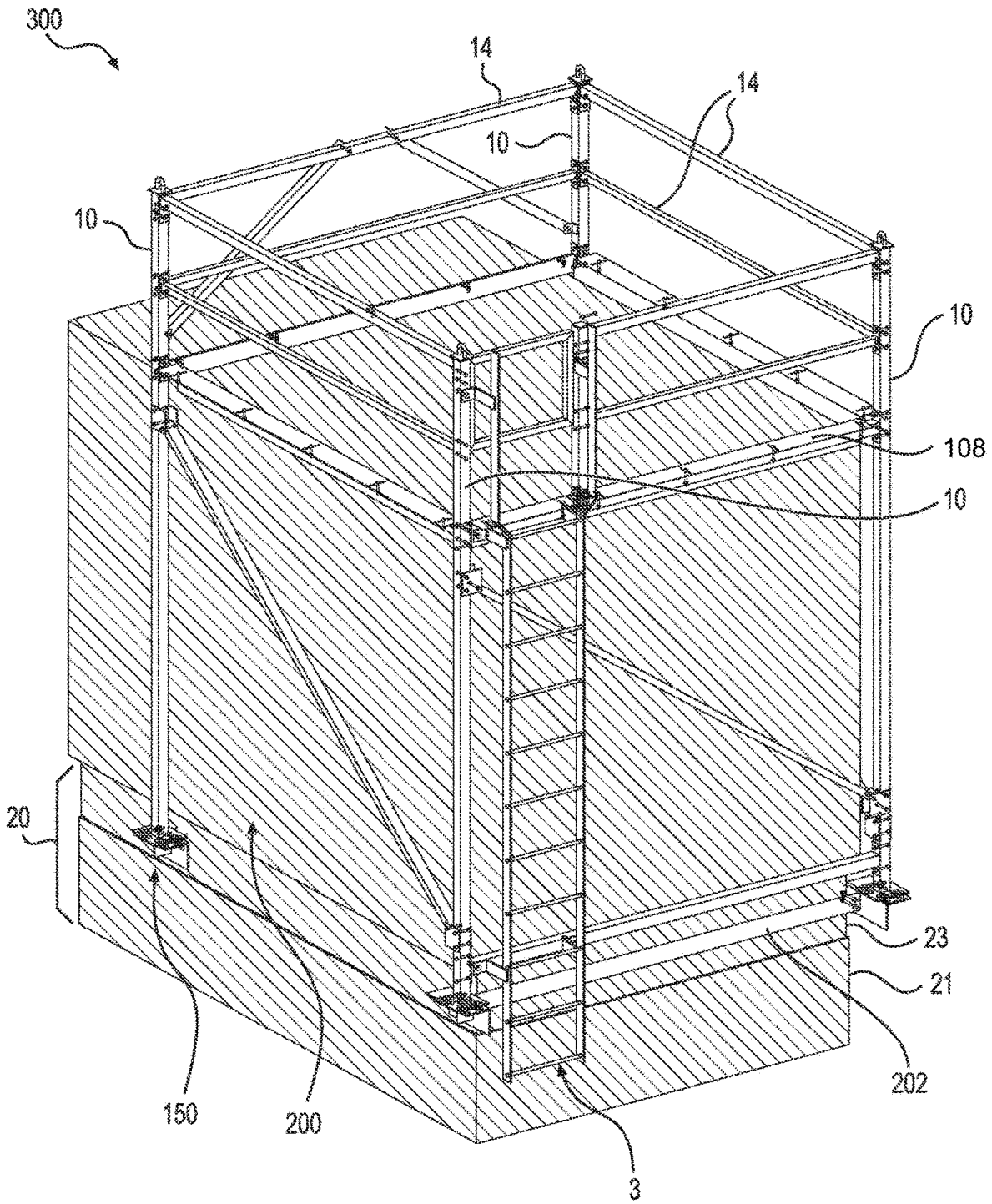
FIGS. 15A, 15B, 15C, 15D, 15E and 15F illustrate a railing system with vertical supports connected to the curb, according to some embodiments.
Figure 15C:
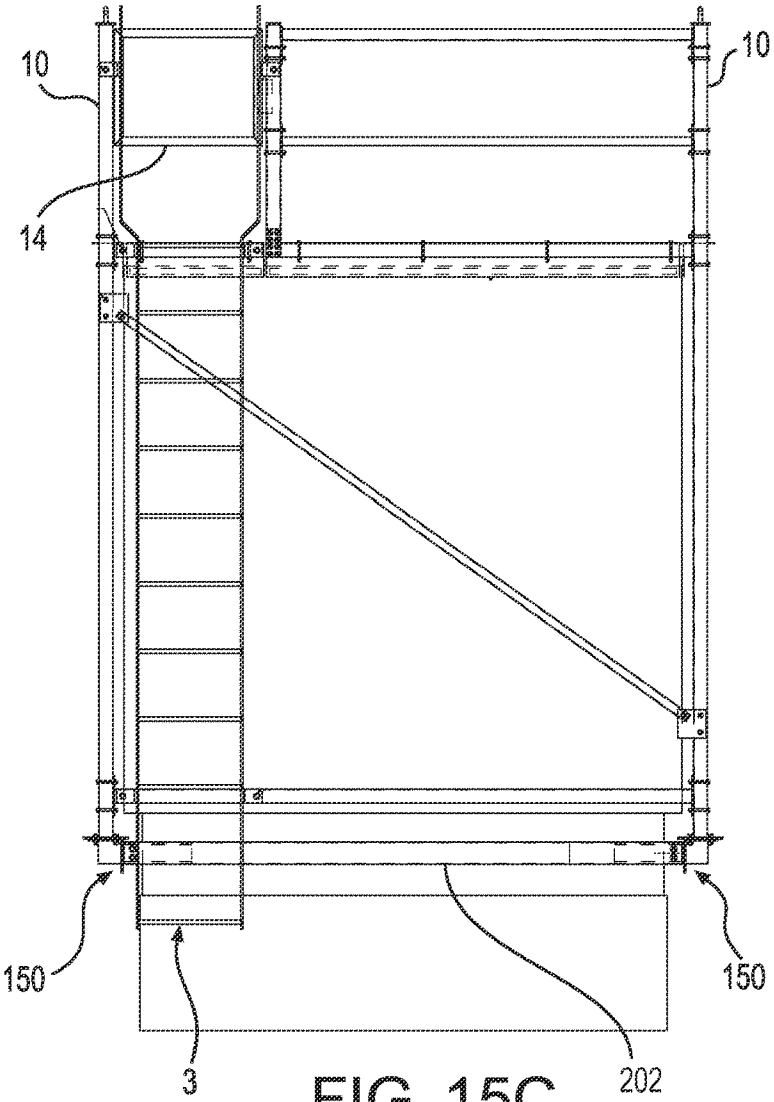
Figure 15B:
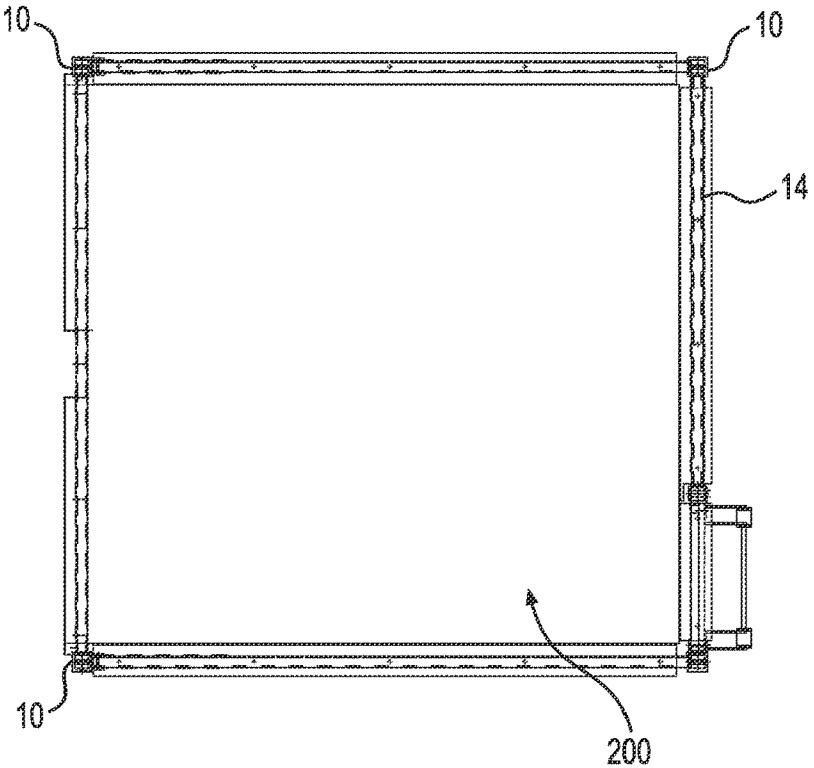
Figure 15F:
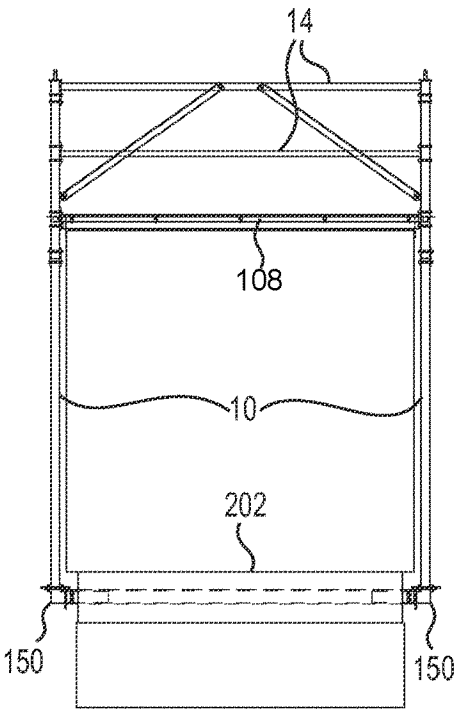
Figure 15E:
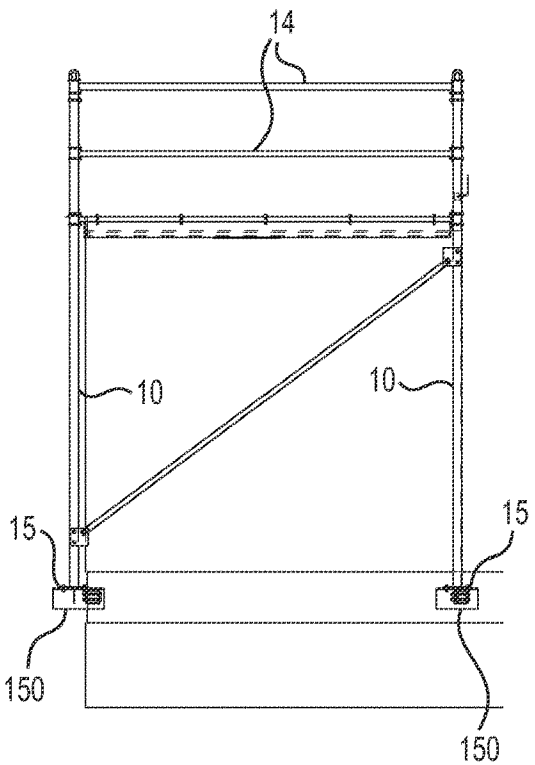
Figure 15D:
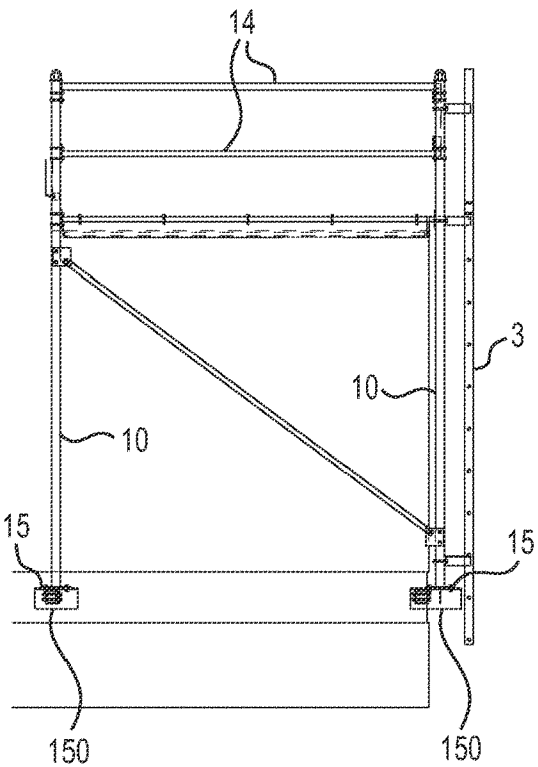

When constructing some curbs, a supporting tube/receiving portion 202 can be inserted or integrally formed in the curb 20 so that the curb will fully and directly support any and all forces applied to the supporting tube/receiving portion 202. The supporting tube/receiving portion 202 for example, may be a metal tube and, once formed or installed, may extend completely from one side of the curb 20 to an opposing side of the curb 20, as shown in FIGS. 15A and 15F. In one embodiment supporting tube 202 need not extend completely between one side of the curb 20 to an opposing side of the curb 20 since all that is needed is an opening that can support the tube insert 204 and a fall load.

The supporting tube 202 may be hollow at least on each end so that it is configured to receive an insert. The supporting tube 202 may be made from a metal such as steel, aluminum, a strong polymer or other like material.

Thus, the curb 20 will include a tube (or otherwise some receiving portion if no tube it provided) with at least on each end a hollow portion.

As shown in FIGS. 15A, 15F, 17A and 17B, a tube insert 204 is configured to be inserted into the hollow end portions of the curb supporting tube/receiving portion 202. The tube insert 204 includes an insert portion 206 and a vertical upright support portion 210. The vertical upright support portion 210 includes a slotted portion 208. The insert portion 206 of the tube insert 204 is inserted into the hollow end portions of the curb tube.

The slotted bracket 208 of the tube insert 204 aligns its slots to corresponding slots of a slotted support bracket 15 so that the slotted bracket 208 of the tube insert 204 connects to the slotted support bracket 15. This connects the vertical supports 10 to the curb 20 via the tube inserts 204 (and system 150). In this regard, the curb 20 fully supports the railing system 300 via connecting system 150 (including tube inserts 204).

The connecting system 150 may be located on each of the four corners and attach to the curb 20 at each of the four corners of the railing system using each of the four vertical supports 10.

Each of the connecting system 150 include adjustable slots so that the bolts that connect the vertical supports 10 to the tube inserts 204 allow the vertical supports 10 to slide horizontally along the slots allowing for adjustments in a direction perpendicular to the longitudinal length of the vertical supports 10. Once the vertical supports 10 are slid to the right position (e.g., the vertical supports are all exactly vertical (e.g., perpendicular to the slots), then the bolts connect the tabs 15 of the vertical supports 10 to the tube inserts 204, respectively, as mentioned above.

Figure 17A:
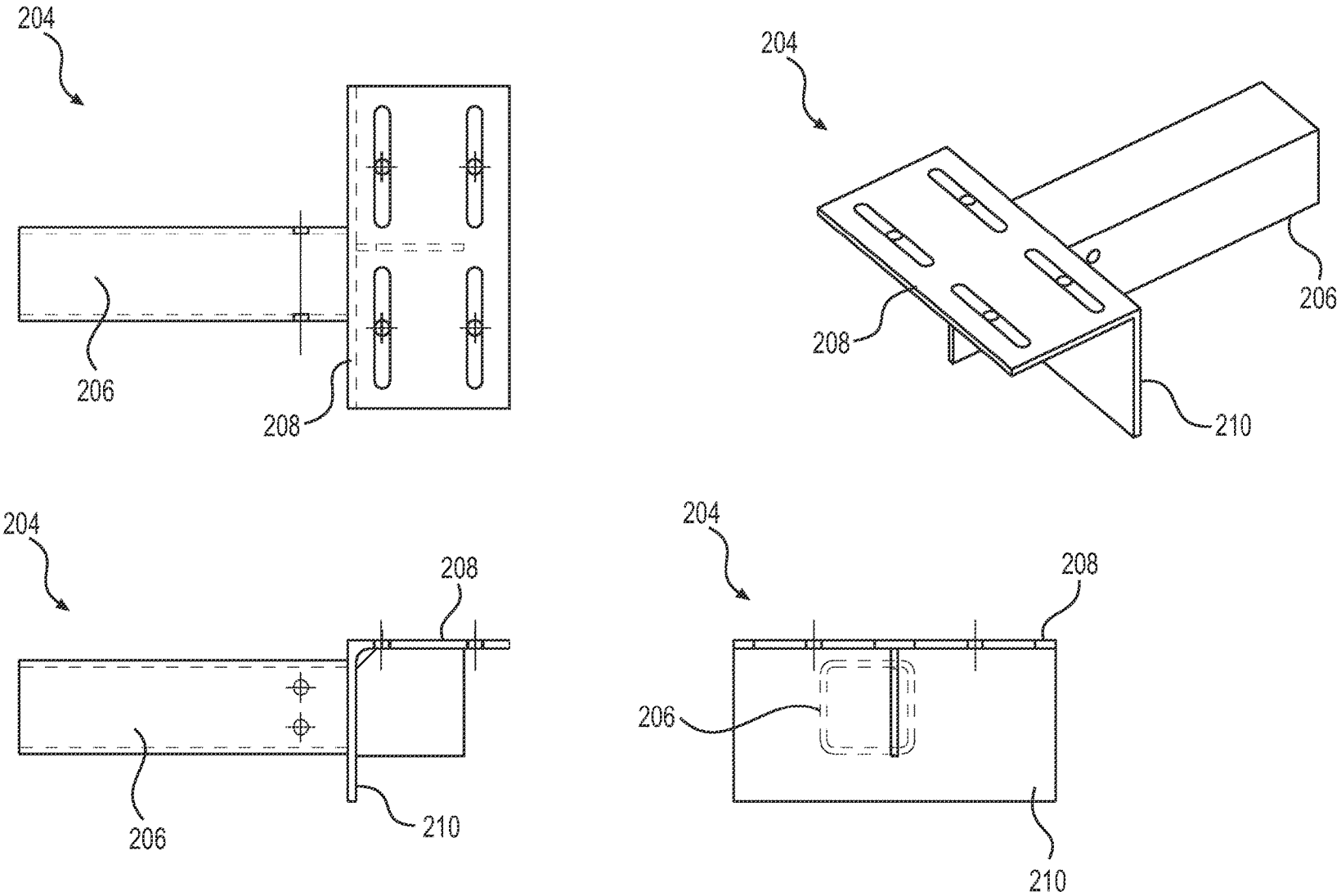
FIGS. 17A and 17B illustrate tube inserts of the condenser railing system according to the embodiment of FIGS. 15A-15F.
Figure 17B:
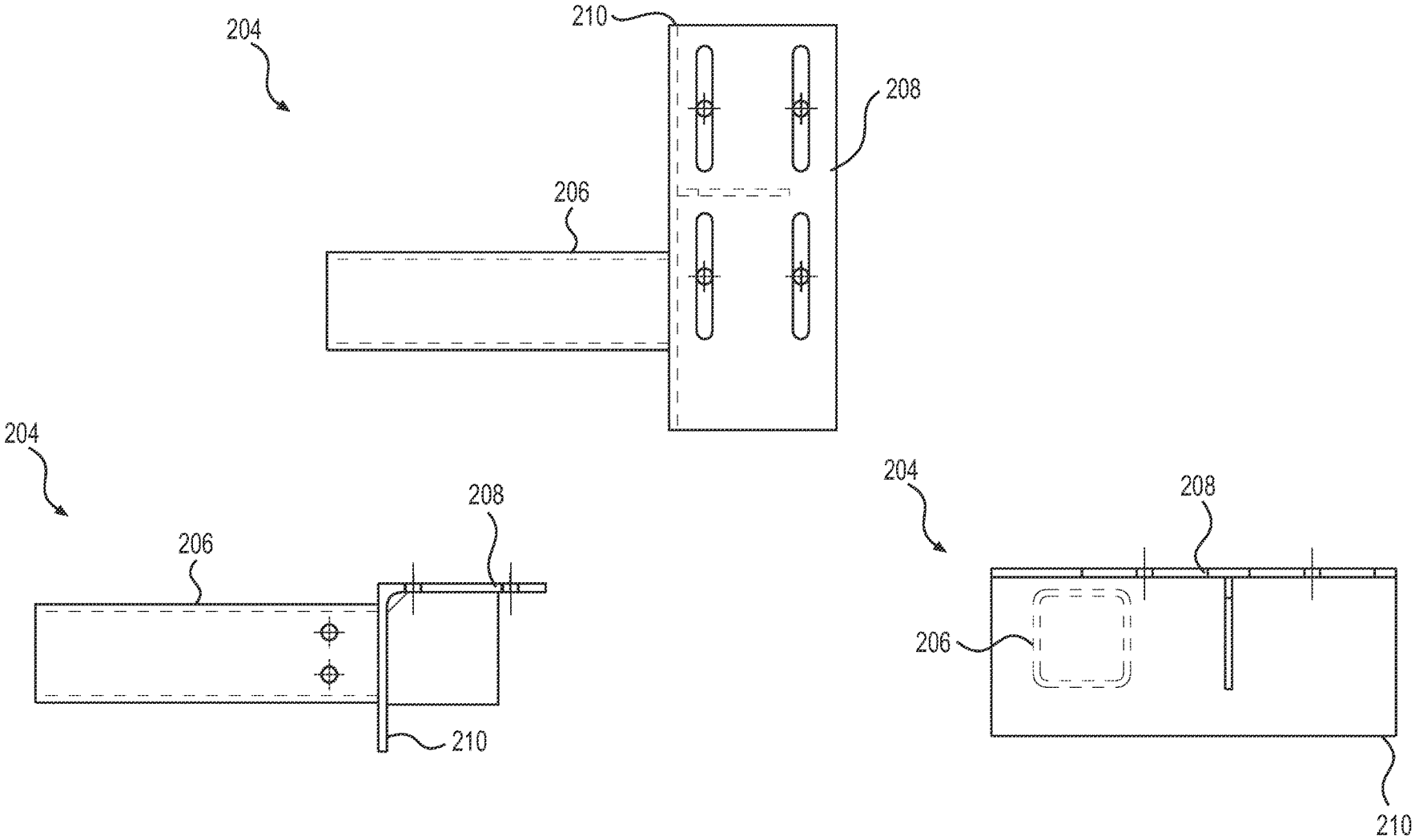

For each of the tube inserts 204, the insert portion 206 of the tube inserts 204 may be centered on the vertical upright support 210. However, in some embodiments, as shown in FIG. 17B, the insert portion 206 of the tube inserts 204 are offset to the vertical upright support 210 to allow the slotted bracket portion 208 to cantilever relative to the curb so that a vertical supports 10 can extend diagonally away from a corner of the RTU. In this regard, the curb 20 still supports the vertical supports even though the tube inserts 204 allow for cantilevering of the bracket supporting portion 208 relative to the curb 20.

This embodiment of the railing system 300 allows for new installs since when the curb is being constructed, the tube/receiving portion 202 can be constructed in the curb 20 to allow for quick installation of railing system 300 using tube inserts 204.

II. Features of Railing Systems

Tie Off Points

In any of the above embodiments of the railing systems 100, 250, and 300, there may be tie off points. A tie off point, as used here is a point where a user can attach to so as to protect the user if the user falls. In this regard, in a fall, the tie off point will support the user's weight fully so the user does not fall off or in the RTU. For example, the user may have a harness that can clip to the tie off point, and if the user falls, the tie off point will fully support the harness and thus the user.

Figure 16A:
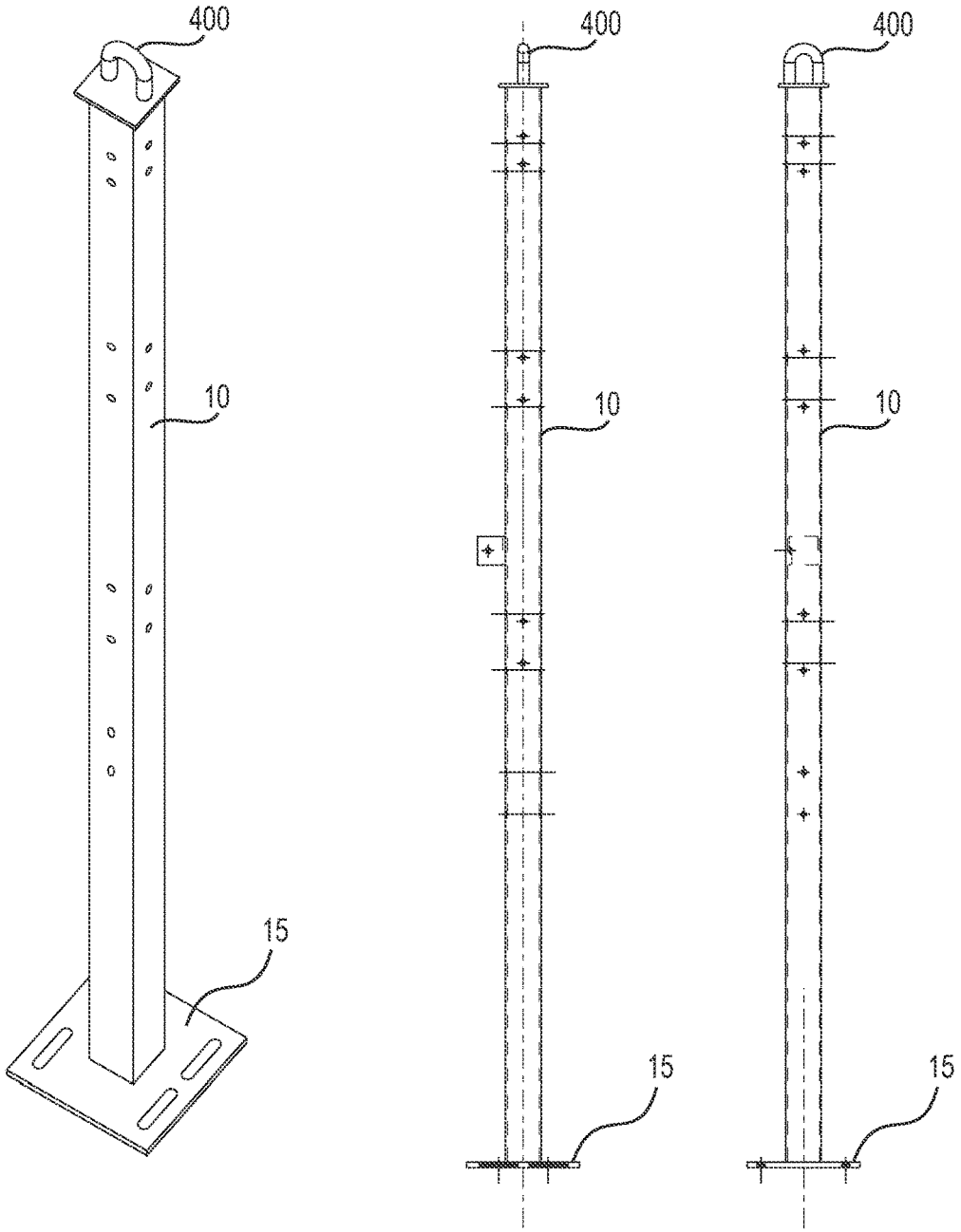
FIGS. 16A and 16B illustrate vertical supports of the condenser railing system according to the embodiment of FIGS. 15A-15F.
Figure 16B:
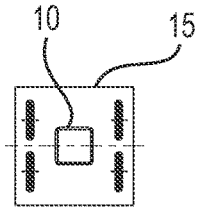

An example, of a tie off point is shown in FIGS. 15A, 16A, and 16B at reference number 400. Indeed, tie off point 400 is shown as a loop that is integrally formed (e.g., via welding) to the vertical supports 10. Any force applied to each tie off point 400 is distributed down the respective vertical supports 10 and eventually to the baserail or curb (depending on which embodiment), and thus, the tie off points are specifically positioned on the vertical supports 10 so that a maximum amount of the force will be distributed to the curb or baserail through the vertical support 10. FIG. 15A shows that there are tie off points 400 at each vertical support 10 on each corner of the railing system. In this regard, the positioning of the tie off points 400 allow a user to connect to a tie off point 400 so that he can access all of the top of the RTU but still be safely attached to a tie off point.

As mentioned above, the vertical supports 10 are configured to support a 5000 lb fall load such that the supports 10 will not fail, shear, or deattach from the curb after receiving a force of 5000 lb.

The tie off point 400 shown in the drawings is an integrally-formed loop that is integrally-formed on the vertical support 10 of a railing system 100, 250, 300 described above. The loop of the tie off point 400 is made of metal and is shown as orientated pointing vertically.

Prior to the present application, there is no way to provide a tie off point to a railing system disposed above an RTU. Tying off to the railing did not provide enough strength to support a user. Tying off on the vertical support has two purposes: 1—the vertical supports provides sufficient structural support to support the weight of a person, and 2—allows a user to access all of the RTU since all four corners can be tie off points.

Floating Floor System

In railing systems, users typically walk on the top surface of the RTU. However, the top surface of the RTU is not designed for a user to walk on it, especially since there are openings for large fans which present a safety risk.

The present application provides a safer alternative to walking on the RTU.

As mentioned above, railing systems 100, 250 and 300 have a horizontal top rail 108 just above the RTU.

Figure 19:
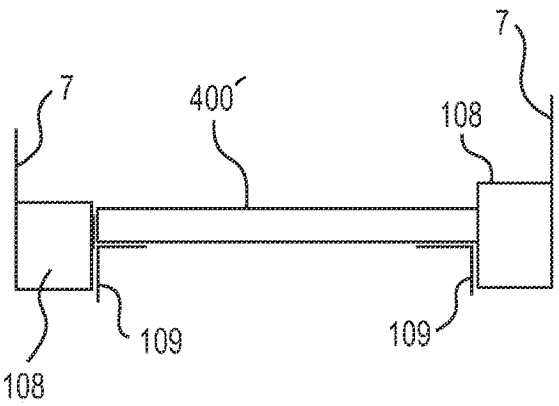
FIG. 19 illustrates a cross-sectional view of the floating floor system, according to some embodiments.
Figure 18:
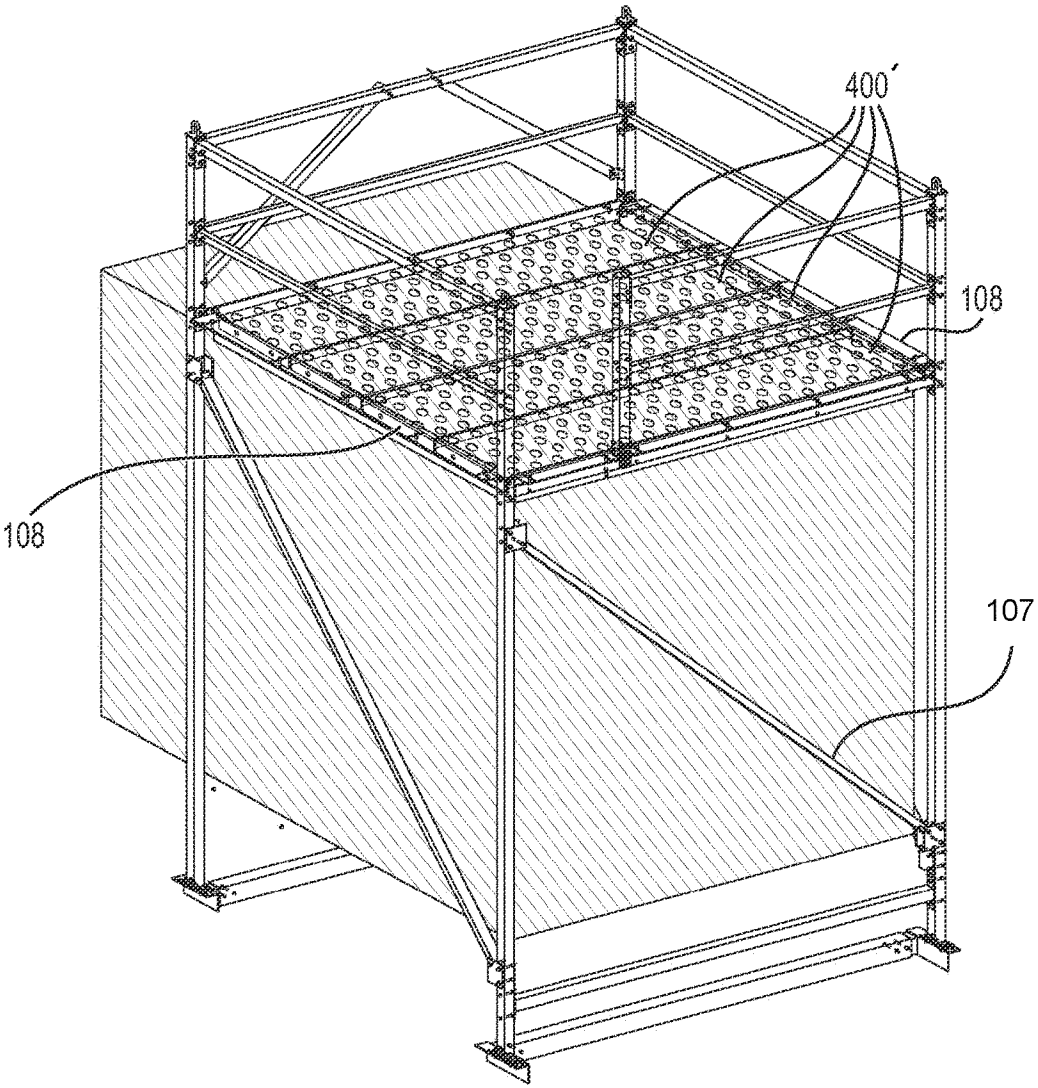
FIG. 18 illustrates a railing system with a floating floor system, according to some embodiments.
Figure 20:
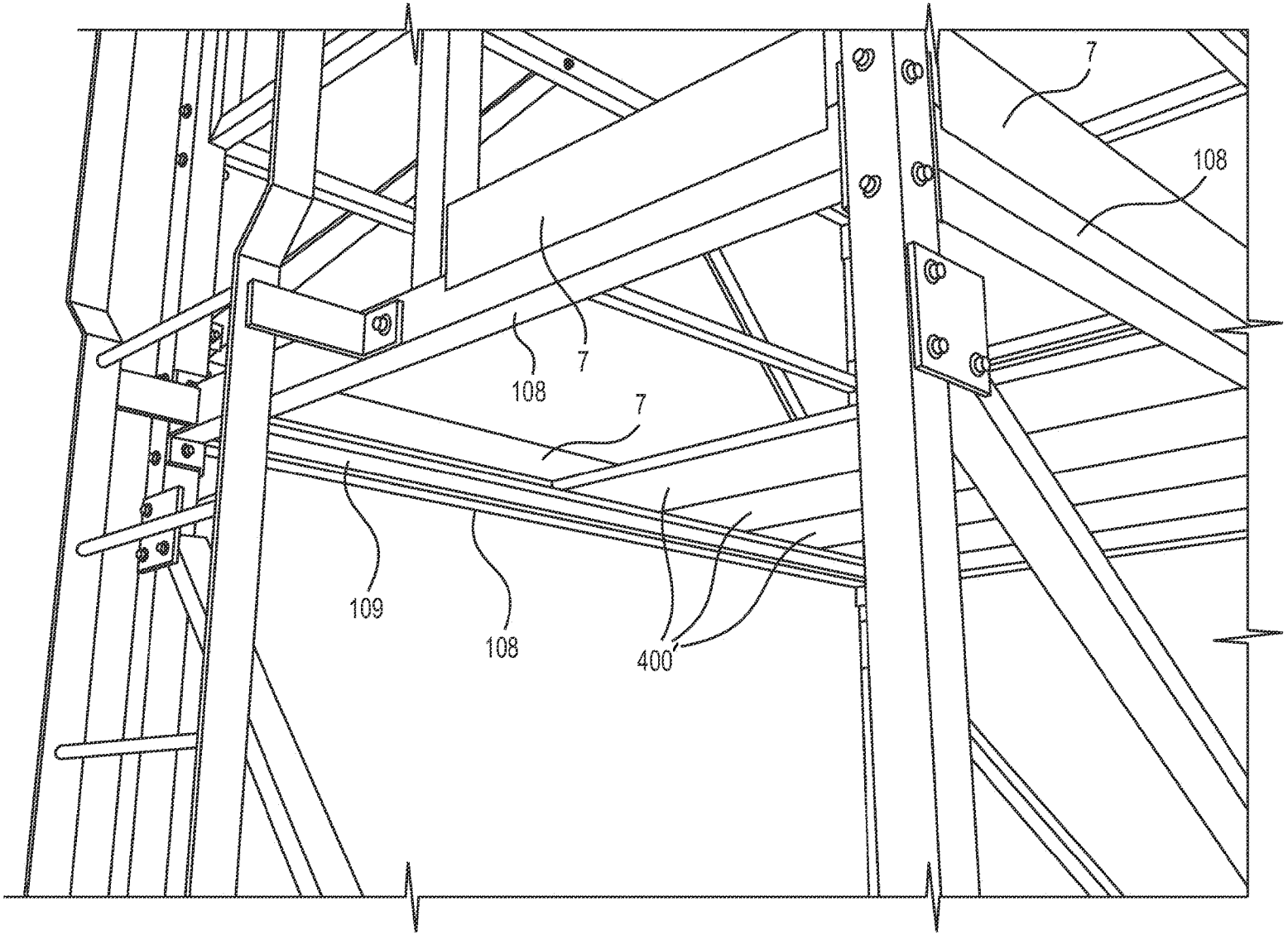
FIG. 20 illustrates a floating floor system partially installed, according to some embodiments.

The horizontal top rail 108 extends completely between two vertical supports 10 in the same direction that the railing 14 extends and is positioned below the toeboard 7 as shown in FIGS. 18-20. There are at least two horizontal top rails 108 on opposing sides of the railing system, as shown in FIGS. 18-20.

The horizontal top rails 108 are configured to distribute any weight disposed thereon to the vertical supports which then distribute the weight to either the curb 20 directly or directly to the baserail 211 of the RTU 201.

Support brackets 109 are configured to attach to an interior portion of the horizontal top rails 108. Support brackets 109 are also configured to receive a plurality of floating floor sections 400'. Each floating floor section has a width that is less than the width of the horizontal top rail 108 so that multiple floating floor sections 400' can be placed side-by-side on the horizontal top rail 108.

The floating floor sections 400' may be made of a sturdy material such as metal (e.g., steel, etc.), and may have holes to provide airflow from the RTU fans disposed underneath the floating floor sections 400' when installed.

In one embodiment, the floating floor sections 400' is removed or uninstalled when the fans of the equipment 201 is running. If the fans were running while the floating floor sections 400' is installed thereover, the fans may blow the floating floor sections 400' off of the track it is installed, creating a safety issue. In this embodiment, the floating floor sections 400' is only for providing an abrasive (e.g., non-slipping) working surface for maintenance and service.

The floating floor sections 400' each have a first end and a second end. Each of the first and second ends are configured to rest on the support brackets 109 and beside of opposing horizontal top rails 108, respectively, so that any weight applied to the floating floor sections 400' are distributed to the support brackets 109 which distributes the weight to the horizontal top rails 108 (and then distributes that force to the vertical supports 10). The floating floor sections 400' have a length that is less than the distance between the two opposing horizontal top rails 108 but has a length that is more than the distance between support brackets 109 on opposing horizontal top rails 108.

It is noted that the horizontal top rails 108 ensures the floating floor sections 400' stay positioned between the horizontal top rails 108. In this regard, the horizontal top rail 108 act as a backstop so that the first and second ends of the floating floor sections 400' stay on the support brackets 109. In this regard, the floating floor sections 400' are a length to rest on both opposing support brackets 109 at the same time and the vertical extending portions ensure that each floating floor section 400' does not slide so that the first and second ends each are not allowed to drop off of either support bracket 109.

The floating floor sections 400' are comprised of a flat piece of metal that has each of the four edge sections bent, broken, or formed to provide more structural strength thereto. The floating floor sections 400' each have an abrasive surface so to prevent a user from slipping on the surface.

Each of the floating floor sections 400' may be placed side by side as shown in FIGS. 18 and 20 to create a floor above the RTU. The floating floor sections 400' may be temporarily secured to the horizontal top rails 108 or support brackets 109 or may not be secured at all. The floating floor sections 400' are configured to be quickly and easily placed on the support brackets 109 by a user or by a machine (e.g., a lift). The floating floor sections 400' then may be removed as quickly and easily as they were installed.

In one embodiment, the floating floor sections 400' may be placed directly on the horizontal top rails 108 instead of the support brackets 109 with the toeboard 7 being the backtop of the floating floor sections 400' to keep the floating floor sections 400' on the horizontal top rails 108.

All of the above description is some optimized implementation method and design choices. Therefore, the foregoing is considered as illustrative only of the principals of the invention. Further, since numerous modifications and changes will readily occur to those skilled in the art, it is not desired to limit the invention to the exact composition and use shown and described, and accordingly, all suitable modifications and equivalents may be restored to, falling within the scope of this invention.

The flowcharts and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems which perform the specified functions or acts, or combinations of special purpose hardware and computer instructions.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to embodiments of the invention in the form disclosed. Many modifications and variations will be apparent to those of ordinary skill in the art without departing from the scope and spirit of embodiments of the invention. The embodiment was chosen and described in order to best explain the principles of embodiments of the invention and the practical application, and to enable others of ordinary skill in the art to understand embodiments of the invention for various embodiments with various modifications as are suited to the particular use contemplated.

Although specific embodiments have been illustrated and described herein, those of ordinary skill in the art appreciate that any arrangement which is calculated to achieve the same purpose may be substituted for the specific embodiments shown and that embodiments of the invention have other applications in other environments. This application is intended to cover any adaptations or variations of the present invention. The following claims are in no way intended to limit the scope of embodiments of the invention to the specific embodiments described herein.

What is claimed is:

1. A railing system to be disposed around industrial/commercial equipment, the industrial/commercial equipment comprising a base rail near the bottom of the industrial/commercial equipment, the railing system comprising:

a plurality of vertical supports extending from the base rail to above a top portion of the industrial/commercial equipment;

railings extending directly between the vertical supports such that a first vertical support of the plurality of vertical supports extends to a top portion of the railings;

at least one attachment clip corresponding to the first vertical support of the plurality of vertical supports and being configured to be attached to the base rail so that the first vertical support is configured to distribute any weight received directly to the base rail via the at least one attachment clip; and a tie off point that is connected to the first vertical support and is configured to support a 5000 lb fall load through the first vertical support directly to the base rail.

2. The railing system of claim 1, wherein each of the plurality of vertical supports comprises a support bracket, and wherein the at least one clip comprises a plurality of attachment clips, each of the attachment clips comprising a second base defining first holes in the second base that are configured to allow for the support bracket of a corresponding vertical support to attach to the at least one clip.

3. The railing system of claim 2, wherein the at least one clip comprises a plurality of attachment clips, each of the attachment clips comprising a base defining holes in the second base to allow for the base to attach to corresponding attachment holes in the base rail.

4. The railing system of claim 1, wherein the at least one attachment clip has holes that allow for connection of the vertical support to the base rail via the at least one attachment clip, the holes extending to allow for a position of the vertical support to be moved along a lengthwise direction of the railings.

5. The railing system of claim 1, wherein the railings extend in a same direction as a lengthwise direction of the one clip, thereby allowing an attachment of the first vertical support to be adjustable along the same direction as the railings.

6. The railing system of claim 1, wherein the at least one attachment clip comprises a plurality of attachment clips that correspond to respective vertical supports of the plurality of vertical supports, and wherein the plurality of vertical supports are configured to distribute any weight received directly to the base rail via the plurality of attachment clips.

7. The railing system of claim 1, wherein the industrial/commercial equipment comprises one of a heating, ventilation, or air-conditioning (HVAC) unit, an air cooled water chiller, a remote condensing unit, a fuel tank, a cooling tower, or a rooftop unit (RTU).

8. The railing system of claim 1, wherein the industrial/commercial equipment comprises a rooftop condensing unit (RTU) that comprises the base rail.

9. The railing system of claim 1, wherein the base rail comprises a structural support portion of the industrial/commercial equipment that is configured to support a 5000 lb fall load.

10. The railing system of claim 1, further comprising an anchorage point positioned at a top of each vertical support.

11. The railing system of claim 1, further comprising:

two horizontal top rails comprising a first horizontal top rail and a second horizontal top rail disposed on a side opposed of the first horizontal top rail; and a floating floor comprising slats that are each configured to be supported via a two horizontal top rails and which is configured to extend over the two horizontal top rails and also over the industrial/commercial equipment.

12. The railing system of claim 11, further comprising support brackets that are configured to be attached to interior portions of the two horizontal top rails, wherein the floating floor is configured to be disposed on the support brackets.

* * * * *